US011810518B2

(12) United States Patent
Heo et al.

(10) Patent No.: US 11,810,518 B2
(45) Date of Patent: Nov. 7, 2023

(54) GATE DRIVING CIRCUIT AND DISPLAY PANEL INCLUDING THE SAME

(71) Applicant: LG DISPLAY CO., LTD., Seoul (KR)

(72) Inventors: Seung Ho Heo, Paju-si (KR); Dong Hyun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/952,440

(22) Filed: Sep. 26, 2022

(65) Prior Publication Data

US 2023/0099461 A1 Mar. 30, 2023

(30) Foreign Application Priority Data

Sep. 27, 2021 (KR) ..... 10-2021-0127043
Dec. 8, 2021 (KR) ..... 10-2021-0174587

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2300/0408* (2013.01); *G09G 2300/0426* (2013.01); *G09G 2310/0289* (2013.01); *G09G 2310/08* (2013.01); *G09G 2320/043* (2013.01)

(58) Field of Classification Search
CPC ..... G09G 3/3266; G09G 3/3677
See application file for complete search history.

(56) References Cited

U.S. PATENT DOCUMENTS

2010/0188385 A1* 7/2010 Boiko ..... G11C 19/184 377/68
2014/0085285 A1* 3/2014 Kim ..... G11C 19/28 377/67
2014/0321599 A1* 10/2014 Cho ..... G11C 19/28 377/64
2017/0097650 A1* 4/2017 Zhang ..... G05F 1/625

FOREIGN PATENT DOCUMENTS

KR 10-2017-0064644 A 6/2017
KR 10-1992158 B1 9/2019
KR 10-2051389 B1 12/2019

* cited by examiner

*Primary Examiner* — Sepehr Azari
(74) *Attorney, Agent, or Firm* — Morgan, Lewis & Bockius LLP

(57) ABSTRACT

A gate driving circuit according to an embodiment and a display panel including the same are disclosed. The gate driving circuit according to the embodiment includes: a controller configured to charge and discharge a first control node that pulls up an output voltage and a second control node that pulls down the output voltage; an output unit including a pull-up transistor configured to apply a gate high voltage to an output node in response to a charging voltage of the first control node, and a pull-down transistor configured to apply a gate low voltage to the output node in response to a charging voltage of the second control node; a sensing unit configured to sense a threshold voltage of the pull-down transistor; and a compensation unit configured to change the charging voltage of the second control node in response to an output of the sensing unit.

20 Claims, 17 Drawing Sheets

GATE DRIVING CIRCUIT AND DISPLAY PANEL INCLUDING THE SAME

CROSS-REFERENCE TO RELATED APPLICATION

This application claims priority to and the benefit of Korean Patent Application No. 10-2021-0127043, filed on Sep. 27, 2021, and Korean Patent Application No. 10-2021-0174587, filed on Dec. 8, 2021, the disclosures of which are incorporated herein by reference in its entirety.

BACKGROUND

1. Technical Field

The present disclosure relates to a gate driving circuit and a display panel including the same.

2. Discussion of the Related Art

Display devices includes a liquid crystal display (LCD) device, an electroluminescence display device, a field emission display (FED) device, a plasma display panel (PDP), and the like.

Electroluminescent display devices are divided into inorganic light emitting display devices and organic light emitting display devices according to a material of a light emitting layer. An active-matrix type organic light emitting display device reproduces an input image using a self-emissive element which emits light by itself, for example, an organic light emitting diode (hereinafter referred to as an "OLED"). An organic light emitting display device has advantages in that a response speed is fast and luminous efficiency, luminance, and a viewing angle are large.

Some of display devices, for example, a liquid crystal display device or an organic light emitting display device includes a display panel including a plurality of sub-pixels, a driver outputting a driving signal for driving the display panel, a power supply generating power to be supplied to the display panel or the driver, and the like. The driver includes a gate driver that supplies a scan signal or a gate signal to the display panel, and a data driver that supplies a data signal to the display panel.

In such a display device, when a driving signal such as a scan signal, an EM signal, and a data signal is supplied to a plurality of sub-pixels formed in the display panel, the selected sub-pixel transmits light or emits light directly to thereby display an image.

In this case, the gate driver outputs a signal once during one frame and maintains a low voltage through turn-on of a pull-down transistor for most of the remaining time. Like the above, the pull-down transistor is driven for a long time and thus has weak reliability due to stress. Accordingly, there is a need for a method capable of improving a circuit lifespan by reducing the stress applied to the pull-down transistor.

SUMMARY

Accordingly, embodiments of the present disclosure are directed to a gate driving circuit and a display panel including the same that substantially obviates one or more of the problems due to limitations and disadvantages of the related art.

An aspect of the present disclosure is to provide a gate driving circuit capable of reducing the stress applied to a pull-down transistor and a display panel including the same.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a gate driving circuit comprises: a controller configured to charge and discharge a first control node that pulls up an output voltage and a second control node that pulls down the output voltage; an output unit including a pull-up transistor configured to apply a gate high voltage to an output node in response to a charging voltage of the first control node, and a pull-down transistor configured to apply a gate low voltage to the output node in response to a charging voltage of the second control node; a sensing unit configured to sense a threshold voltage of the pull-down transistor; and a compensation unit configured to change the charging voltage of the second control node in response to an output of the sensing unit.

In another aspect, a display panel comprises a data driver configured to output a data voltage; a gate driver configured to output a gate signal according to voltages of a first control node that pulls up an output voltage and a second control node that pulls down the output voltage; and a plurality of pixel circuits configured to receive the data voltage and the gate signal to reproduce an input image, wherein the gate driver includes: a controller configured to charge and discharge the first control node and the second control node; an output unit including a pull-up transistor configured to apply a gate signal of a gate high voltage to an output node in response to a charging voltage of the first control node, and a pull-down transistor configured to apply a gate signal of a gate low voltage to the output node in response to a charging voltage of the second control node; a sensing unit configured to sense a threshold voltage of the pull-down transistor; and a compensation unit configured to change the charging voltage of the second control node in response to an output of the sensing unit.

In the present disclosure, the stress of a pull-down transistor can be reduced by sensing a threshold voltage of the pull-down transistor in an output unit of a gate driving circuit and varying a voltage applied to a Qb node or a gate node of the pull-down transistor according to the sensed threshold voltage, and accordingly, a circuit lifespan can be improved.

In the present disclosure, since an initial voltage applied to the Qb node is low and thus a gate-source voltage of the pull-down transistor is lowered, a threshold voltage increase of the pull-down transistor can be delayed.

It is to be understood that both the foregoing general description and the following detailed description are exemplary and explanatory and are intended to provide further explanation of the inventive concepts as claimed.

BRIEF DESCRIPTION OF THE DRAWINGS accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
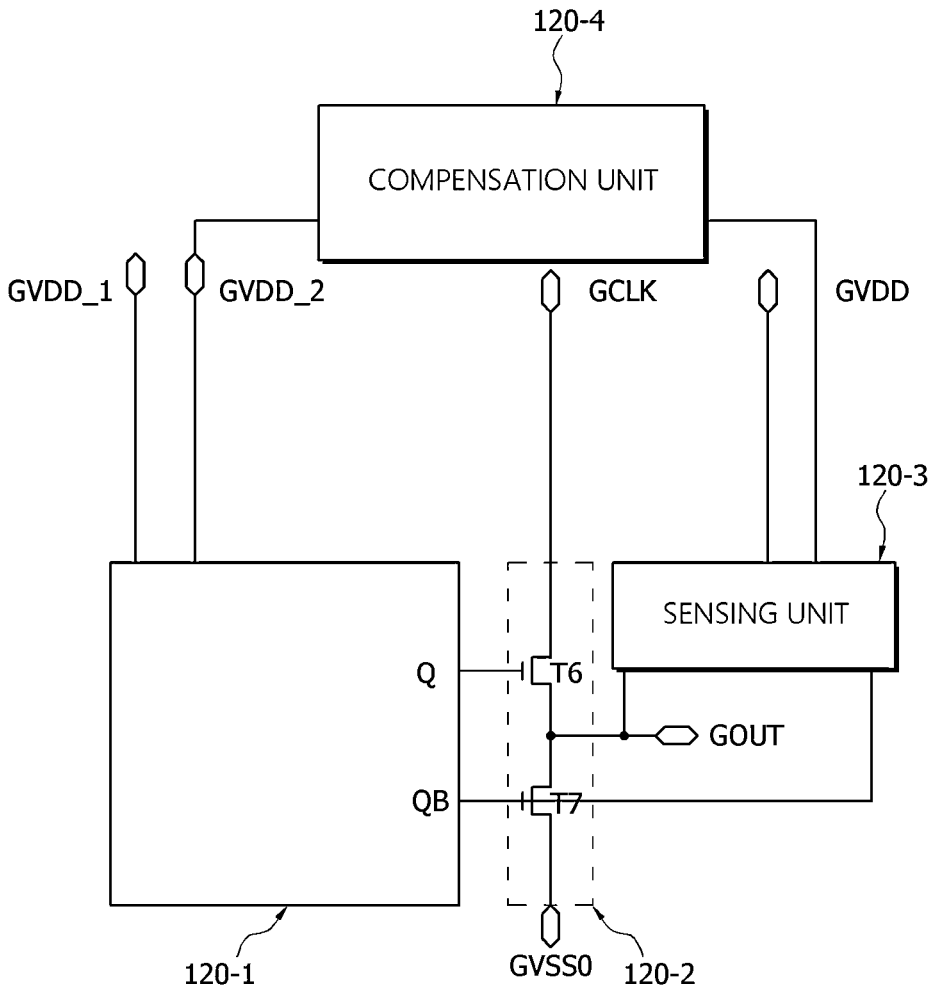
FIG. 1 is a view illustrating a gate driving circuit according to a first embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," and "having," used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The same reference numerals may refer to substantially the same elements throughout the present disclosure.

The following embodiments can be partially or entirely bonded to or combined with each other and can be linked and operated in technically various ways. The embodiments can be carried out independently of or in association with each other.

Hereinafter, various embodiments of the present disclosure will be described in detail with reference to the accompanying drawings.

FIG. 1 is a view illustrating a gate driving circuit according to a first embodiment of the present disclosure.

Referring to FIG. 1, the gate driving circuit according to the first embodiment of the present disclosure may include a first control node (hereinafter referred to as a "Q node") that pulls up an output voltage, a second control node (hereinafter referred to as a "QB node") that pulls down the output voltage, a controller 120-1, an output unit 120-2, a sensing unit 120-3, and a compensation unit 120-4.

The controller 120-1 may serve to charge and discharge the first control node and the second control node.

The output unit 120-2 may output a gate signal in response to charging voltages of the first control node and the second control node. The output unit 120-2 may include a pull-up transistor and a pull-down transistor. The pull-up transistor may output a gate high voltage to an output node in response to the charging voltage of the first control node, and the pull-down transistor may output a gate low voltage to the output node in response to the charging voltage of the second control node.

The sensing unit 120-3 may sense a threshold voltage of the pull-down transistor.

The compensation unit 120-4 may change the charging voltage of the second control node in response to an output of the sensing unit. In this case, in the embodiment, a high potential voltage line which applies a high potential voltage to the first control node and the second control node may be separated to apply a first high potential voltage to the first control node through a first high potential voltage GVDD_1 line and apply a second high potential voltage to the second control node through a second high potential voltage GVDD_2 line. Accordingly, the compensation unit 120-4 may change the charging voltage of the second control node by changing the magnitude of the second high potential voltage applied through the second high potential voltage GVDD_2 line in response to the output of the sensing unit.

Figure 2:
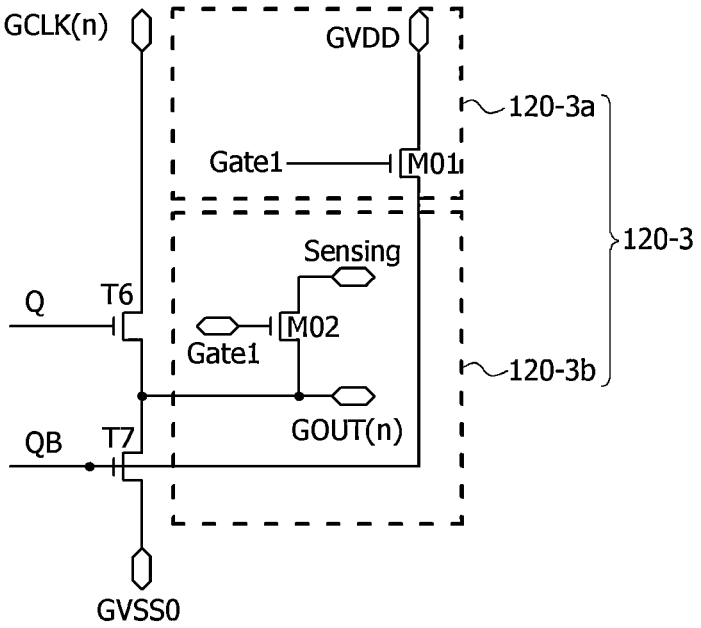
FIG. 2 is a view illustrating a configuration of a sensing unit shown in FIG. 1.
Figure 3:
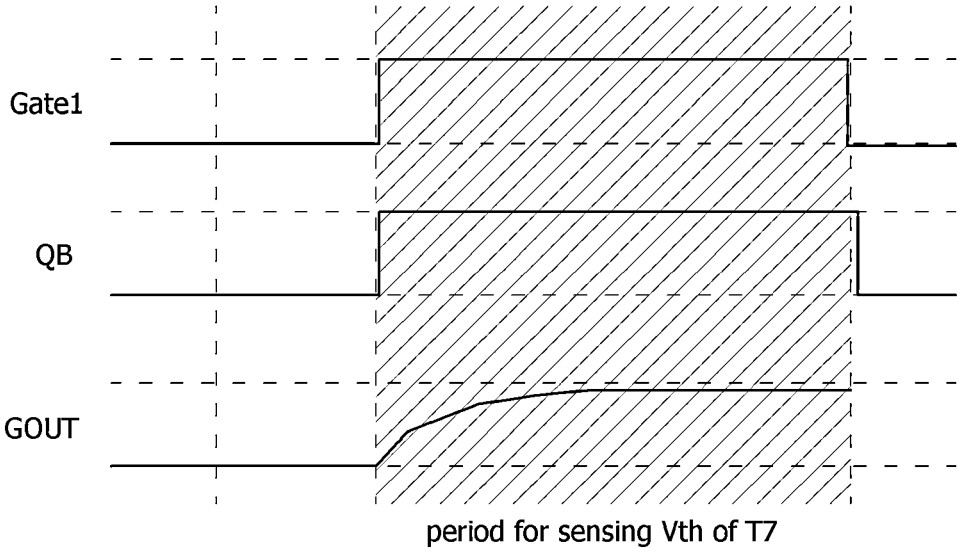
FIG. 3 is a waveform diagram illustrating voltages of input/output signals and nodes of the sensing unit shown in FIG. 2.

FIG. 2 is a view illustrating a configuration of the sensing unit shown in FIG. 1, and FIG. 3 is a waveform diagram illustrating voltages of input/output signals and nodes of the sensing unit shown in FIG. 2.

According to FIGS. 2 and 3, the sensing unit 120-3 according to the embodiment may include a first sensing unit 120-3*a* formed of a first switch element M01 and a second sensing unit 120-3*b* formed of a second switch element M02. For example, the first sensing unit may apply an initialization voltage to the second control node, and the second sensing unit may sense the threshold voltage of the pull-down transistor.

The first switch element M01 may be turned on to apply a high potential voltage to the second control node QB when a gate signal is at a high voltage greater than or equal to a gate-on voltage. The first switch element M01 includes a gate electrode to which the gate signal Gate1 is applied, a first electrode connected to the high potential voltage line to which the high potential voltage GVDD is applied, and a second electrode connected to the second control node.

The second switch element M02 may be turned on to sense the threshold voltage of the pull-down transistor and transmit the threshold voltage to a sensing line when the gate signal is at the high voltage greater than or equal to the gate-on voltage. The second switch element M02 includes a gate electrode to which a gate signal Gate 1 is applied, a first electrode connected to the sensing line Sensing, and a second electrode connected to the output node GOUT(n).

As shown in FIG. 3, the first switch element M01 and the second switch element M02 may be turned on to sense the threshold voltage Vth of the pull-down transistor during a section in which a high voltage of a first gate signal is maintained.

Figure 4:
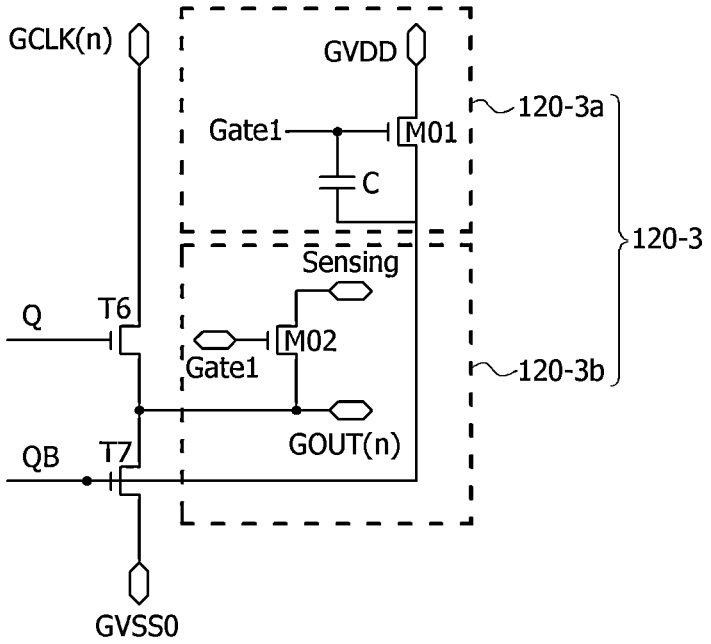
FIG. 4 is a view illustrating another configuration of the sensing unit shown in FIG. 1.
Figure 5:
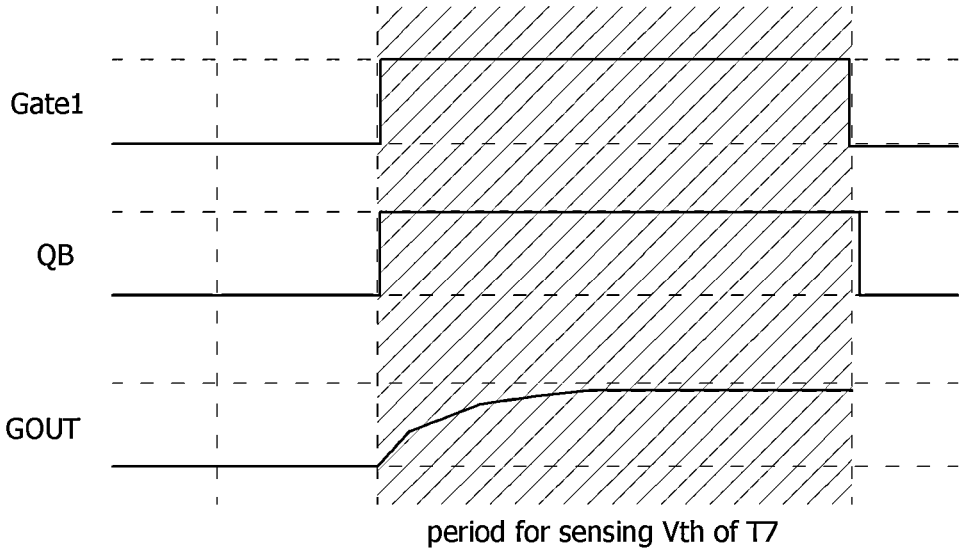
FIG. 5 is a waveform diagram illustrating voltages of input/output signals and nodes of the sensing unit shown in FIG. 4.

FIG. 4 is a view illustrating another configuration of the sensing unit shown in FIG. 1, and FIG. 5 is a waveform diagram illustrating voltages of input/output signals and nodes of the sensing unit shown in FIG. 4.

Referring to FIGS. 4 and 5, a sensing unit 120-3 according to the embodiment may include a first sensing unit 120-3*a* formed of a first switch element M01 and a capacitor C, and a second sensing unit 120-3*b* formed of a second switch element M02.

The first switch element M01 may be turned on to apply a high potential voltage to the second control node when a gate signal is at a high voltage greater than or equal to a gate-on voltage. The first switch element M01 includes a gate electrode to which the gate signal Gate 1 is applied, a first electrode connected to the high potential voltage line, and a second electrode connected to the second control node.

The second switch element M02 may be turned on to sense the threshold voltage of the pull-down transistor and transmit the threshold voltage to the sensing line when the gate signal is at the high voltage greater than or equal to the gate-on voltage. The second switch element M02 includes a gate electrode to which the gate signal Gate 1 is applied, a first electrode connected to the sensing line Sensing, and a second electrode connected to the output node GOUT(n).

The capacitor C is connected between the gate electrode and a source node of the first switch element M01. The capacitor C may serve to form a bootstrapping voltage at a gate node.

As shown in FIG. 5, the first switch element M01 and the second switch element M02 may be turned on to sense the threshold voltage Vth of the pull-down transistor during a section in which a high voltage of a first gate signal is maintained. In this case, transmission performance may be improved by bootstrapping through coupling of the capacitor C.

Figure 6:
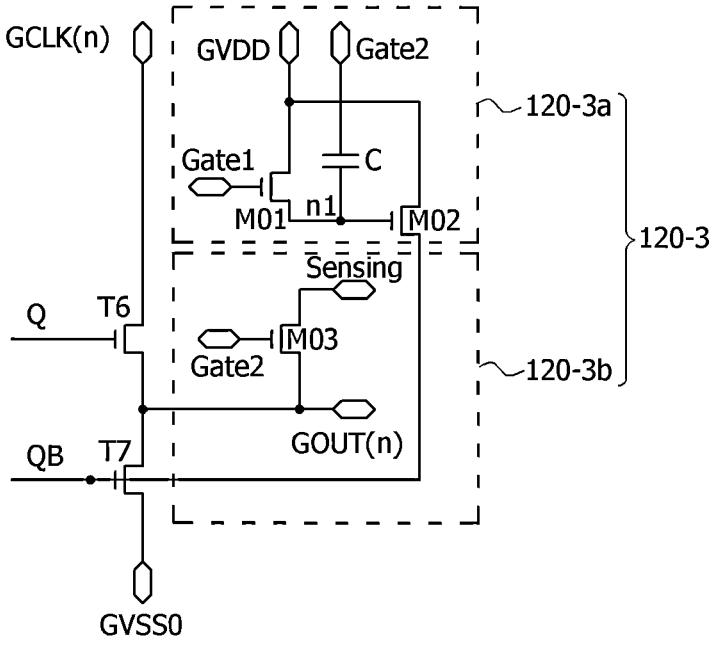
FIG. 6 is a view illustrating still another configuration of the sensing unit shown in FIG. 1.
Figure 7:
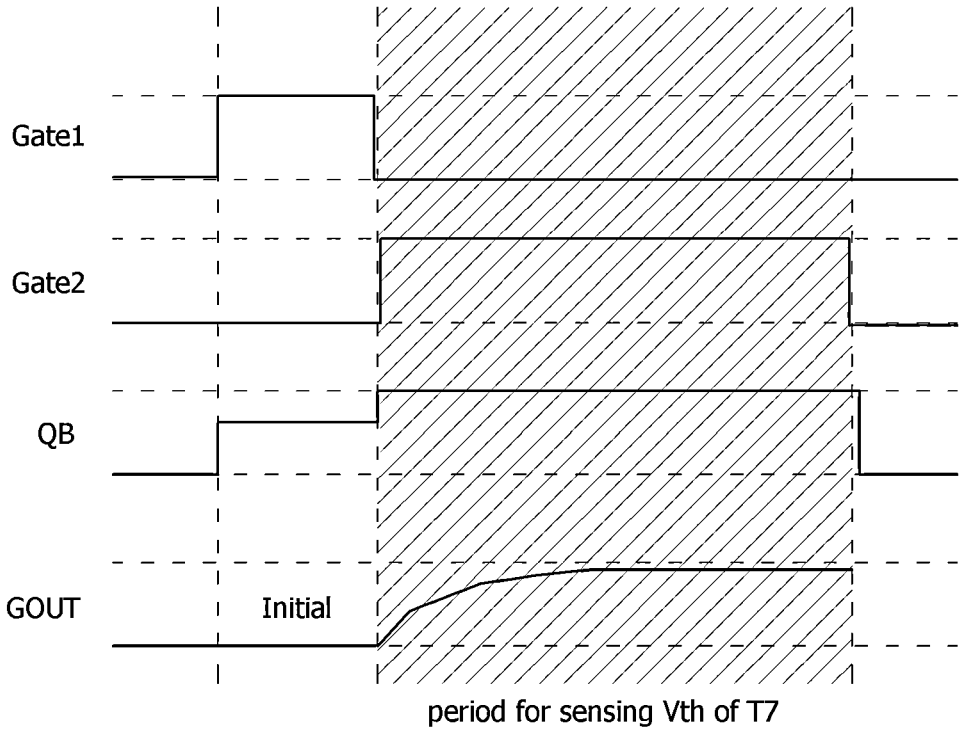
FIG. 7 is a waveform diagram illustrating voltages of input/output signals and nodes of the sensing unit shown in FIG. 6.

FIG. 6 is a view illustrating still another configuration of the sensing unit shown in FIG. 1, and FIG. 7 is a waveform diagram illustrating voltages of input/output signals and nodes of the sensing unit shown in FIG. 6.

Referring to FIGS. 6 and 7, a sensing unit 120-3 according to the embodiment may include a first sensing unit 120-3*a* formed of a first switch element M01, a second switch element M02, and a capacitor C, and a second sensing unit 120-3*b* formed of a third switch element M03.

The first switch element M01 may be turned on to apply a high potential voltage to a first node n1 when a first gate signal is at a high voltage greater than or equal to a gate-on voltage. The first switch element M01 includes a gate electrode to which the first gate signal Gate 1 is applied, a first electrode connected to the high potential voltage line to which the high potential voltage GVDD is applied, and a second electrode connected to the first node n1.

The second switch element M02 may be turned on to apply the high potential voltage to the second control node when the voltage of the first node n1 is a high voltage greater than or equal to the gate-on voltage. The second switch element M02 includes a gate electrode connected to the first node n1, a first electrode connected to the high potential voltage line to which the high potential voltage GVDD is applied, and a second electrode connected to the second control node.

The third switch element M03 may be turned on to sense the threshold voltage of the pull-down transistor and transmit the threshold voltage to the sensing line when a second gate signal is at a high voltage greater than or equal to the gate-on voltage. The third switch element M03 includes a gate electrode to which the second gate signal Gate 2 is applied, a first electrode connected to the sensing line Sensing, and a second electrode connected to the output node GOUT(n).

The capacitor C is connected between the signal line to which the second gate signal Gate2 is applied and the first node n1. The capacitor C may serve to form a bootstrapping voltage at the first node.

As shown in FIG. 7, a section in which the threshold voltage is sensed may include a first section in which the high voltage of the first gate signal is maintained and a second section in which the high voltage of the second gate signal is maintained. The first switch element M01 and the second switch element M02 may be turned on in the first section, and the second switch element M02 and the third switch element M03 may be turned on in the second section. In this case, sensing performance, that is, transmission performance, may be improved by the bootstrapping through the coupling of the capacitor C.

Figure 8A:
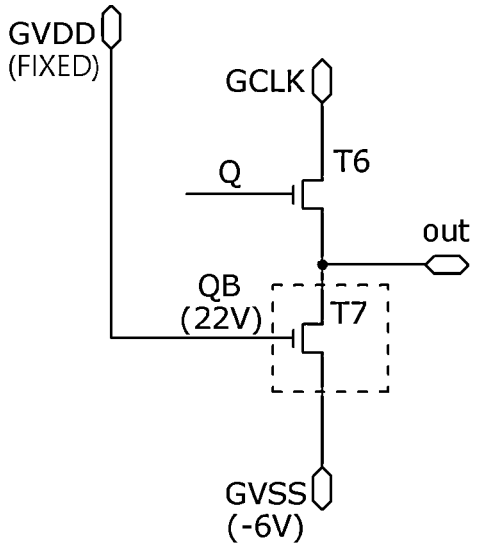
FIGS. 8A and 8B are views for describing a threshold voltage change of a pull-down transistor shown in FIG. 1.
Figure 8A:
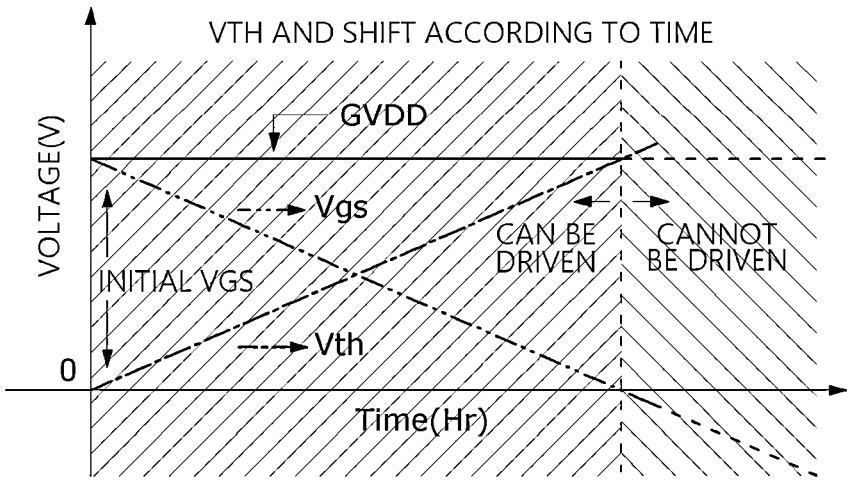
Figure 8B:
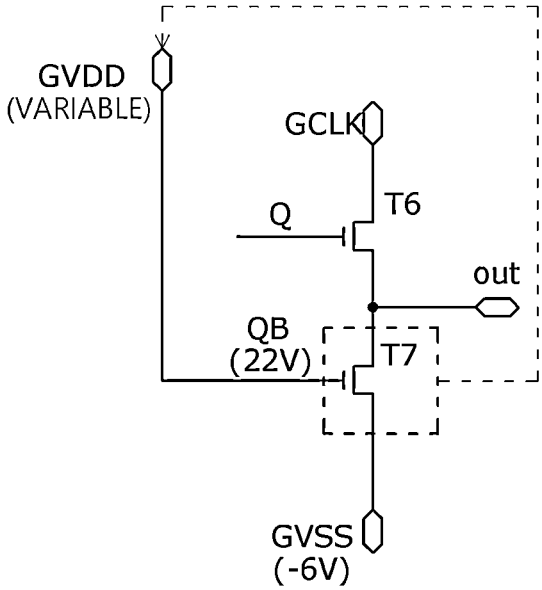
Figure 8B:
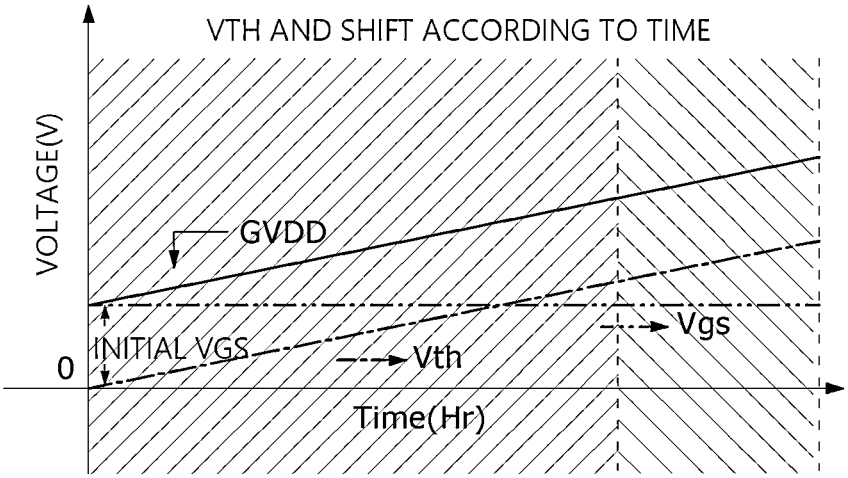

FIGS. 8A and 8B are views for describing a threshold voltage change of the pull-down transistor shown in FIG. 1.

Referring to FIG. 8A, in a comparative example, when the high potential voltage applied to the second control node is fixed, since an initial high potential voltage is applied at a low level and thus an initial gate-source voltage Vgs of the pull-down transistor is formed to be high, an increase in the threshold voltage Vth may occur.

In this case, the gate-source voltage Vgs may be defined as in the following Equation 1.

$$Vgs=Vg-Vs-Vth=GVDD-GVSSVth \quad \text{[Equation 1]}$$

Here, Vg is a voltage of a gate node, Vs is a voltage of a source node, Vth is a threshold voltage, GVDD is a high potential voltage, and GVSS is a low potential voltage.

A change amount (ΔVth) of the threshold voltage may be expressed as in the following Equation 2.

$$\Delta V_{th} = (V_{gs} - V_{th,0}) \times \left\{1 - \exp\left[-\left(\frac{t}{\tau}\right)^{\beta}\right]\right\},\ \tau = \nu^{-1}\exp\left(\frac{E_A}{kT}\right) \quad \text{[Equation 2]}$$

Here, t denotes time, τ denotes a time constant, β denotes a constant which expresses dispersion, $E_A$ denotes activation energy, v denotes frequency, k denotes Boltzmann's constant, and T denotes temperature.

Referring to FIG. 8B, in the embodiment, when the high potential voltage applied to the second control node is varied, the initial high potential voltage is applied at a low level and is increased through sensing of the threshold voltage. Since the initial high potential voltage is applied at a low level and thus the initial gate-source voltage Vgs of the pull-down transistor is formed to be low, the increase in the threshold voltage Vth may be delayed.

Since the high potential voltage is gradually increased through the sensing of the threshold voltage, the increase in the threshold voltage Vth is delayed that much, and accordingly, a lifespan of the transistor may also increase.

Figure 9:
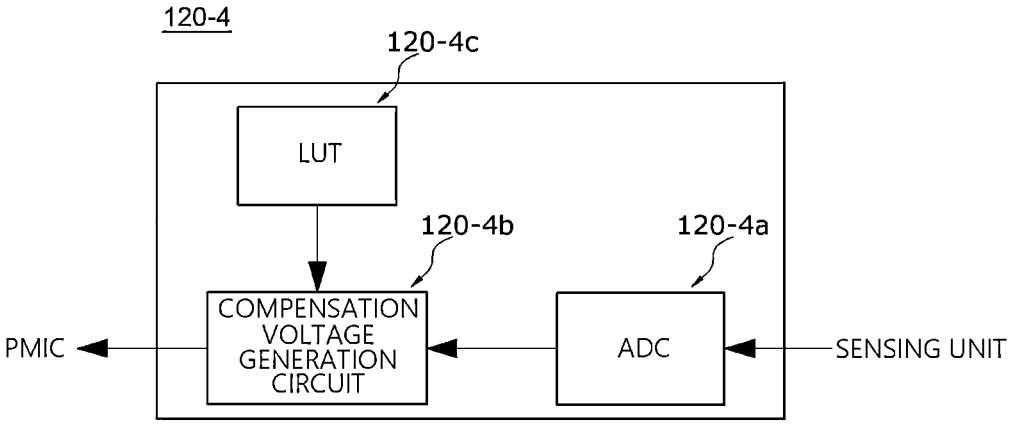
FIG. 9 is a view illustrating a configuration of a compensation unit shown in FIG. 1.

FIG. 9 is a view illustrating a configuration of a compensation unit shown in FIG. 1.

Referring to FIG. 9, the compensation unit according to the embodiment may include an analog-to-digital converter (ADC) 120-4*a* and a compensation voltage generation circuit 120-4*b*.

The analog-to-digital converter 120-4*a* may convert a voltage sensed through the sensing line, that is, a threshold voltage of the pull-down transistor, to digital data.

The compensation voltage generation circuit 120-4*b* may change the magnitude of the high potential voltage based on the converted digital data and a look-up table (LUT) 120-4*c* and apply the high potential voltage to the QB node. In this case, the compensation voltage generation circuit 120-4*b* may change the high potential voltage in proportion (positive proportion) to the sensed threshold voltage.

For example, the compensation voltage generation circuit 120-4*b* may change the magnitude of the high potential voltage to be applied to the QB node through a power management integrated circuit (PMIC) by determining the magnitude of the high potential voltage based on the converted digital data and lookup table, and inputting an instruction signal for instructing a change to the high potential voltage of the determined magnitude to the PMIC.

Figure 10:
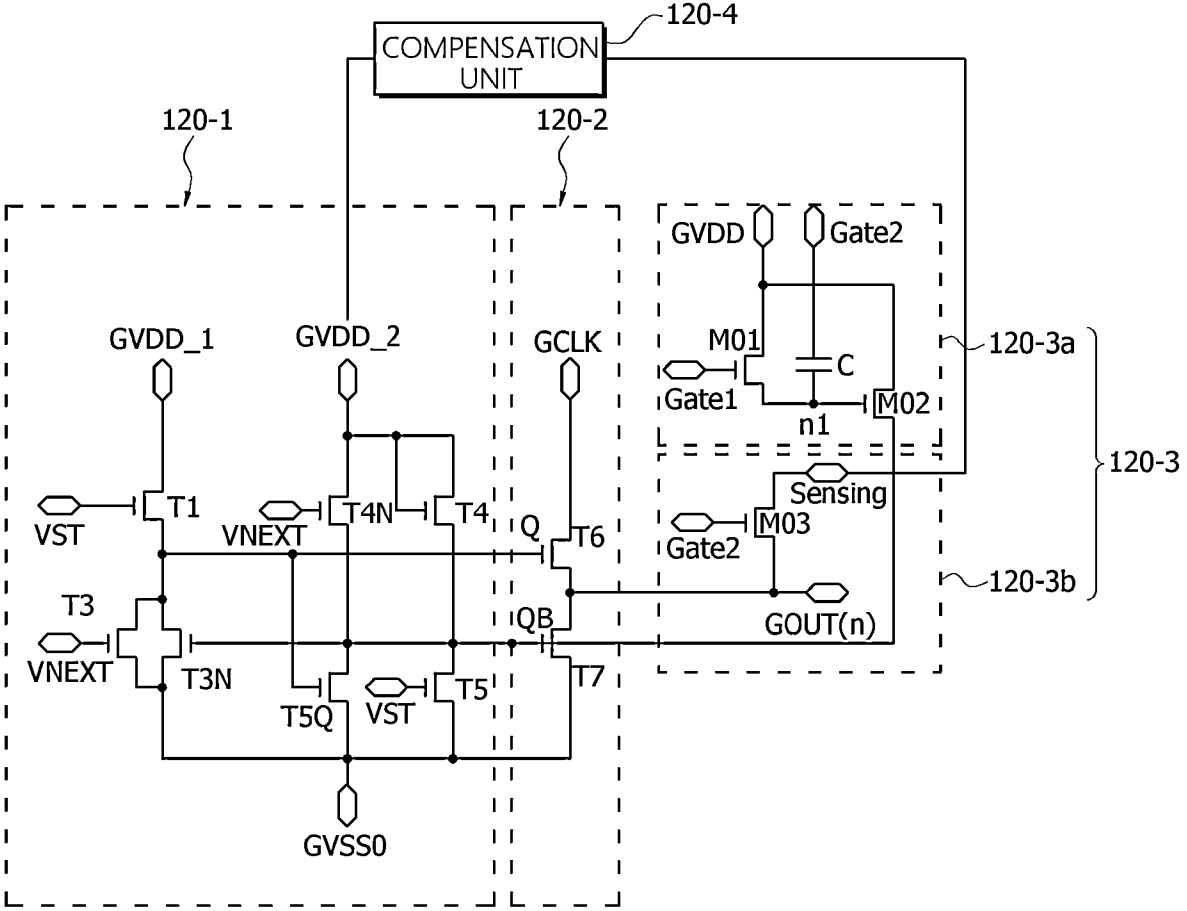
FIG. 10 is a view illustrating a gate driving circuit according to a second embodiment of the present disclosure.
Figure 11:
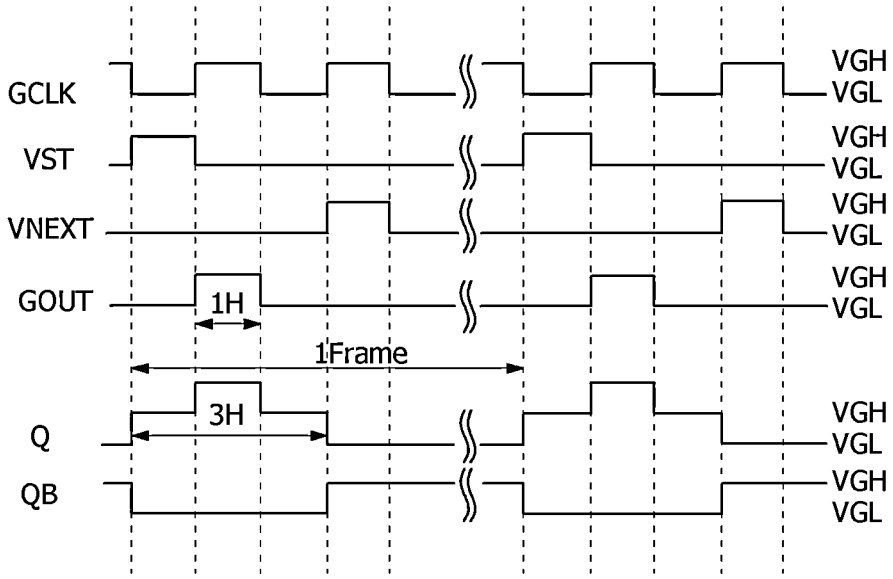
FIG. 11 is a waveform diagram illustrating voltages of input/output signals and nodes of the gate driving circuit.

FIG. 10 is a view illustrating a gate driving circuit according to a second embodiment of the present disclosure, and FIG. 11 is a waveform diagram illustrating voltages of input/output signals and nodes of the gate driving circuit.

Referring to FIGS. 10 and 11, the gate driving circuit according to the second embodiment includes a controller 120-1, an output unit 120-2, a sensing unit 120-3 composed of a first sensing unit 120-3*a* and a second sensing unit 120-3*b*, and a compensation unit 120-4.

The controller 120-1 may serve to charge and discharge a first control node and a second control node. The controller 120-1 may include a first transistor T1, a third transistor T3, a third-N transistor T3N, a fourth transistor T4, a fourth-N transistor T4N, a fifth transistor T5, and a fifth-Q transistor T5Q.

The first transistor T1 may supply a gate-on voltage VGH to a Q node in response to a start pulse VST received through a VST terminal. The first transistor T1 includes a gate electrode connected to the VST terminal, a first electrode connected to a high potential voltage line to which a high potential voltage GVDD_1 is applied, and a second electrode connected to the Q node.

The third transistor T3 may be turned on to discharge the Q node in response to a carry signal VNEXT of a next signal transmission unit received through a VNEXT terminal. The third transistor T3 includes a gate electrode connected to the VNEXT terminal, a first electrode connected to the Q node, and a second electrode connected to a low potential voltage line to which a low potential voltage GVSS0 is applied.

The third-N transistor T3N may discharge the Q node in response to a voltage of a QB node. The third-N transistor T3N includes a gate electrode connected to the QB node, a first electrode connected to the Q node, and a second electrode connected to the low potential voltage line to which the low potential voltage GVSS0 is applied.

The fourth transistor T4 may be turned on by the high potential voltage GVDD_2 and may transmit the high potential voltage applied to the high potential voltage line to the QB node. The fourth transistor T4 includes a gate electrode and a first electrode commonly connected to the high potential voltage line, and a second electrode connected to the QB node.

The fourth-N transistor T4N may be turned on to supply the high potential voltage GVDD_2 to the QB node to charge the QB node to a voltage greater than or equal to the gate-on voltage VGH in response to the carry signal VNEXT of the next signal transmission unit received through the VNEXT terminal. The fourth-N transistor T4N includes a gate electrode connected to the VNEXT terminal, a first electrode connected to the high potential voltage line, and a second electrode connected to the QB node.

The fifth transistor T5 connects the QB node to the low potential voltage line to discharge the QB node to the low potential voltage GVSS0 in response to the start pulse VST received through the VST terminal. The fifth transistor T5 includes a gate electrode connected to the VST terminal, a first electrode connected to the QB node, and a second electrode connected to the low potential voltage line.

The fifth-Q transistor T5Q is turned on and connects the QB node to the low potential voltage line to discharge the QB node to the low potential voltage when a voltage of the Q node Q is a high voltage greater than or equal to the gate-on voltage VGH. The fifth-Q transistor T5Q includes a gate electrode connected to the Q node Q, a first electrode connected to the QB node, and a second electrode connected to the low potential voltage line.

The output unit 120-2 may output a gate signal in response to charging voltages of the first control node and the second control node. The output unit 120-2 may include buffer transistors T6 and T7 which output the gate signal. The buffer transistors T6 and T7 may be divided into a pull-up transistor T6 that is turned on based on a potential of the Q node Q and a pull-down transistor T7 that is turned on based on a potential of the QB node QB. The pull-up transistor T6 includes a gate electrode connected to the Q node Q, a first electrode connected to a clock signal line CLK to which a clock signal GCLK is applied, and a second electrode connected to an output terminal GOUT(n). The pull-down transistor T7 includes a gate electrode connected to the QB node QB, a first electrode connected to the output terminal GOUT(n), and a second electrode connected to a low potential voltage GVSS0 line.

The sensing unit 120-3 may sense a threshold voltage of the pull-down transistor. The sensing unit 120-3 includes a first sensing unit 120-3*a* composed of a first switch element M01, a second switch element M02, and a capacitor C, and a second sensing unit 120-3*b* composed of a third switch element M03.

The first switch element M01 may be turned on to apply a high potential voltage to a first node n1 when a first gate signal is at a high voltage greater than or equal to the gate-on voltage. The first switch element M01 includes a gate electrode to which the first gate signal Gate1 is applied, a first electrode connected to the high potential voltage line to which the high potential voltage GVDD is applied, and a second electrode connected to the first node n1.

The second switch element M02 may be turned on to apply the high potential voltage to the second control node when the voltage of the first node n1 is a high voltage greater than or equal to the gate-on voltage. The second switch element M02 includes a gate electrode connected to the first node n1, a first electrode connected to the high potential voltage line to which the high potential voltage GVDD is applied, and a second electrode connected to the second control node.

The third switch element M03 may be turned on to sense the threshold voltage of the pull-down transistor and transmit the threshold voltage to a sensing line when a second control signal is at a high voltage greater than or equal to the gate-on voltage. The third switch element M03 includes a gate electrode to which the second control signal Gate2 is applied, a first electrode connected to the sensing line Sensing, and a second electrode connected to an output node GOUT(n).

The capacitor C is connected between the signal line to which the second gate signal Gate2 is applied and the first node n1. The capacitor C may serve to form a bootstrapping voltage at the first node.

The compensation unit 120-4 may change the charging voltage of the second control node in response to an output of the sensing unit. The compensation unit 120-4 may change a second high potential voltage applied to a second high potential voltage GVDD_2 line connected to the second control node in response to the output of the sensing unit.

The compensation unit 120-4 may change the second high potential voltage applied to the second high potential voltage GVDD_2 line in proportion to the threshold voltage of the pull-down transistor T7 sensed by the sensing unit.

Figure 12:
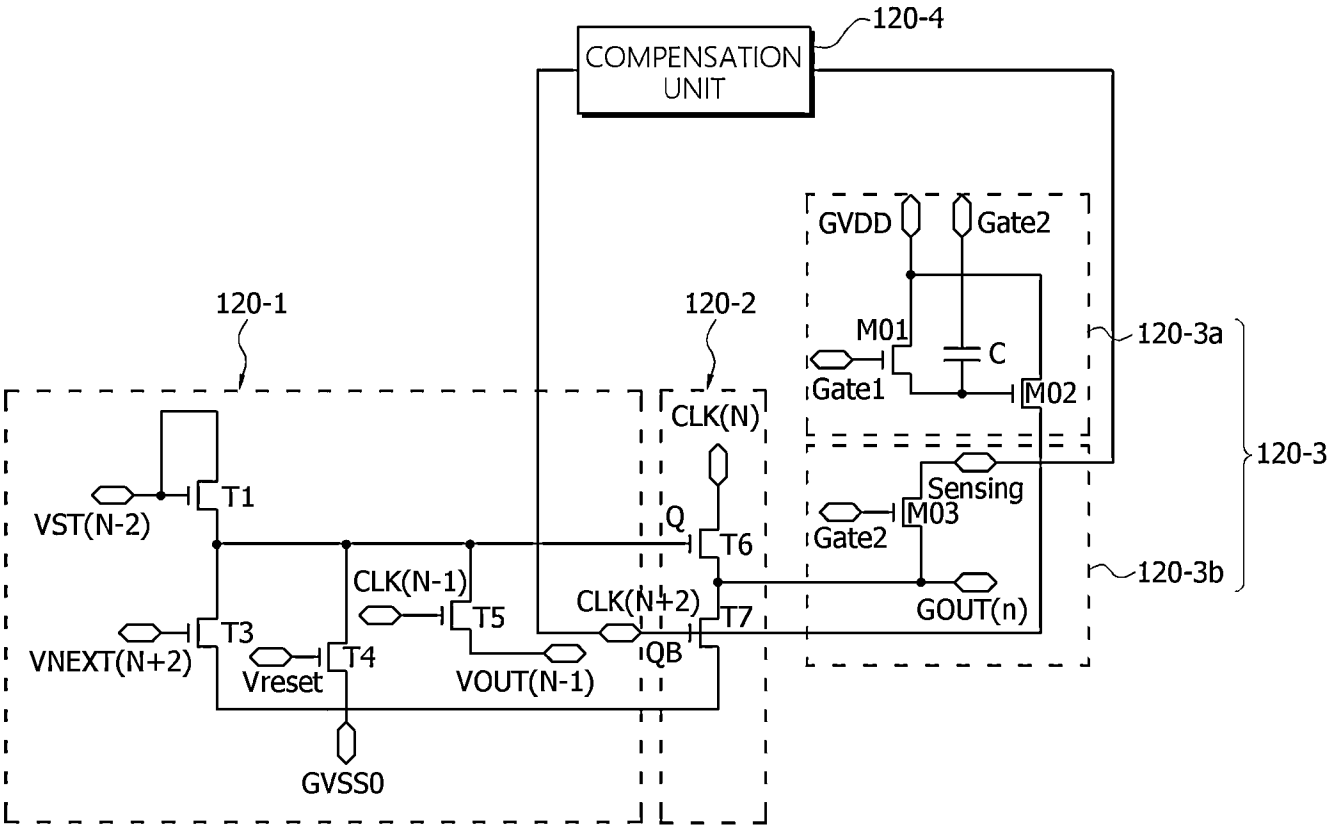
FIG. 12 is a view illustrating a gate driving circuit according to a third embodiment of the present disclosure.
Figure 13:
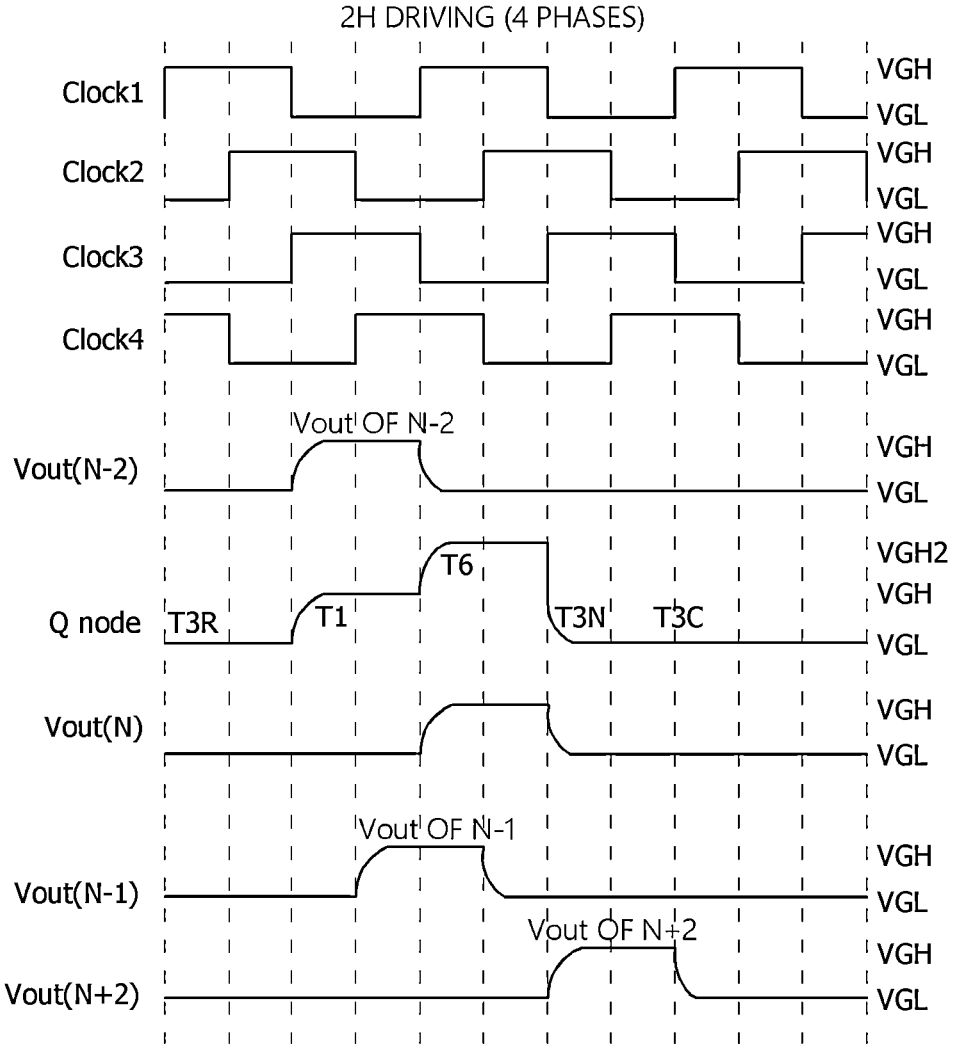
FIG. 13 is a waveform diagram illustrating voltages of input/output signals and nodes of the gate driving circuit.

FIG. 12 is a view illustrating a gate driving circuit according to a third embodiment of the present disclosure, and FIG. 13 is a waveform diagram illustrating voltages of input/output signals and nodes of the gate driving circuit.

Referring to FIGS. 12 and 13, the gate driving circuit according to the third embodiment includes a controller 120-1, an output unit 120-2, a sensing unit 120-3 composed of a first sensing unit 120-3*a* and a second sensing unit 120-3*b*, and a compensation unit 120-4.

The controller 120-1 may serve to charge and discharge a first control node. The controller 120-1 may include a first transistor T1, a third transistor T3, a fourth transistor T4, and a fifth transistor T5.

The first transistor T1 may supply a gate-on voltage VGH to a Q node in response to a start pulse VST(N−2) received through a VST terminal (start pulse terminal). The first transistor T1 includes a gate electrode and a first electrode commonly connected to the VST terminal, and a second electrode connected to the Q node. Vout(N−2) shown in FIG. 13 corresponds to the start pulse VST(N−2).

The third transistor T3 may be turned on to discharge the Q node in response to a carry signal VNEXT(N+2) of a next signal transmission unit received through a VNEXT terminal (carry signal terminal). The third transistor T3 includes a gate electrode connected to the VNEXT terminal, a first electrode connected to the Q node, and a second electrode connected to a low potential voltage line to which a low potential voltage GVSS0 is applied. Vout(N+2) shown in FIG. 13 corresponds to the carry signal VNEXT(N+2).

The fourth transistor T4 may discharge the Q node in response to a reset signal Vreset received through a VRESET terminal (reset signal terminal). The fourth transistor T4 includes a gate electrode connected to the VRESET terminal, a first electrode connected to the Q node, and a second electrode connected to the low potential voltage line.

The fifth transistor T5 may be turned on to connect the Q node to an output terminal VOUT(N−1) of a previous signal transmission unit in response to a clock signal CLK(N−1) of the previous signal transmission unit. The fifth transistor T5 includes a gate electrode to which the clock signal of the previous signal transmission unit is applied, a first electrode connected to the Q node, and a second electrode connected to an output terminal of the previous signal transmission unit.

The output unit 120-2 may output a gate signal to an output terminal GOUT(n) in response to charging voltages of the first control node Q and the second control node QB. The output unit 120-2 may include buffer transistors T6 and T7 which output the gate signal. The buffer transistors T6 and T7 may be divided into a pull-up transistor T6 that is turned on based on a potential of the Q node Q and a pull-down transistor T7 that is turned on based on a potential of a clock signal CLK(N+2) of a next signal transmission unit. The pull-up transistor T6 includes a gate electrode connected to the Q node Q, a first electrode connected to a clock signal line CLK to which a clock signal CLK(N) is applied, and a second electrode connected to the output terminal GOUT(n). The pull-down transistor T7 includes a gate electrode to which the clock signal CLK(N+2) of the next signal transmission unit is applied, a first electrode connected to the output terminal GOUT(n), and a second electrode connected to a low potential voltage GVSS0 line.

The sensing unit 120-3 may sense a threshold voltage of the pull-down transistor. The sensing unit 120-3 includes a first sensing unit 120-3*a* composed of a first switch element M01, a second switch element M02, and a capacitor C, and a second sensing unit 120-3*b* composed of a third switch element M03.

The first switch element M01 may be turned on to apply a high potential voltage to a first node when a first gate signal is at a high voltage greater than or equal to a gate-on voltage. The first switch element M01 includes a gate electrode to which the first gate signal Gate1 is applied, a first electrode connected to a high potential voltage line to which the high potential voltage GVDD is applied, and a second electrode connected to the first node.

The second switch element M02 may be turned on to apply the high potential voltage to a gate node of the pull-down transistor when the voltage of the first node is a high voltage greater than or equal to the gate-on voltage. The second switch element M02 includes a gate electrode connected to the first node, a first electrode connected to the high potential voltage line to which the high potential voltage GVDD is applied, and a second electrode connected to the gate node of the pull-down transistor.

The third switch element M03 may be turned on to sense the threshold voltage of the pull-down transistor and transmit the threshold voltage to a sensing line when a second gate signal is at a high voltage greater than or equal to the gate-on voltage. The third switch element M03 includes a gate electrode to which the second gate signal Gate2 is applied, a first electrode connected to the sensing line Sensing, and a second electrode connected to an output node GOUT(n).

The capacitor C is connected between the signal line to which the second gate signal Gate2 is applied and the first node. The capacitor C may serve to form a bootstrapping voltage at the first node.

The compensation unit 120-4 may change a voltage of the gate node of the pull-down transistor in response to an output of the sensing unit. The compensation unit 120-4 may change a voltage or magnitude of a second clock signal Clock2 applied to a second clock signal line connected to the gate node in response to the output of the sensing unit.

The compensation unit 120-4 may change the voltage or magnitude of the second clock signal Clock2 applied to the second clock signal line in proportion to the threshold voltage of the pull-down transistor T7 sensed by the sensing unit.

Figure 14:
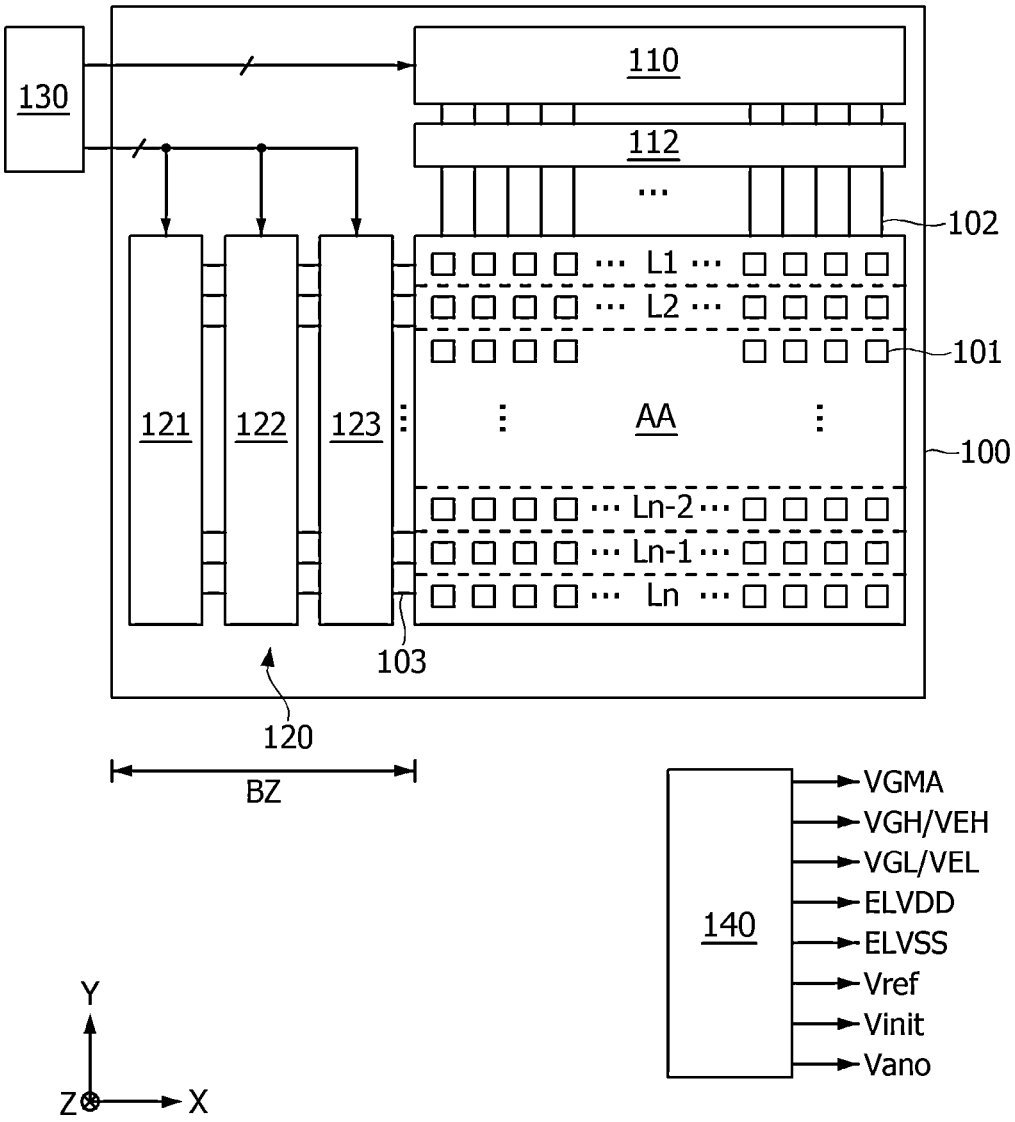
FIG. 14 is a block diagram illustrating a display device according to the embodiment of the present disclosure.
Figure 15:
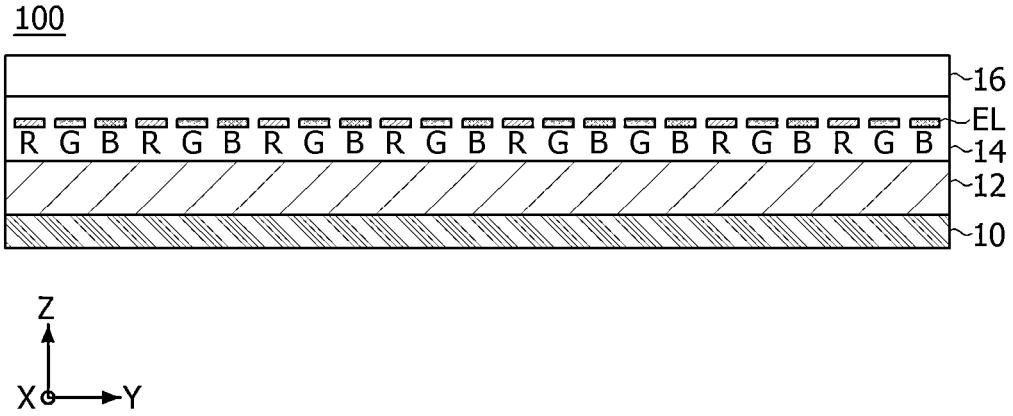
FIG. 15 is a view illustrating a cross-sectional structure of a display panel shown in FIG. 14.

FIG. 14 is a block diagram illustrating a display device according to an embodiment of the present disclosure, and FIG. 15 is a diagram illustrating a cross-sectional structure of the display panel shown in FIG. 14.

Referring to FIGS. 14 and 15, the display device according to an embodiment of the present disclosure includes a display panel 100, a display panel driver for writing pixel data to pixels of the display panel 100, and a power supply 140 for generating power necessary for driving the pixels and the display panel driver.

The display panel 100 may be a display panel having a rectangular structure having a length in an X-axis direction, a width in a Y-axis direction, and a thickness in a Z-axis direction. The display panel 100 includes a pixel array AA that displays an input image. The pixel array AA includes a plurality of data lines 102, a plurality of gate lines 103 intersected with the data lines 102, and pixels arranged in a matrix form. The display panel 100 may further include power lines commonly connected to pixels. The power lines may include a power line to which a pixel driving voltage ELVDD is applied, a power line to which an initialization voltage Vinit is applied, a power line to which a reference voltage Vref is applied, and a power line to which a low potential power voltage ELVSS is applied. These power lines are commonly connected to the pixels.

The pixel array AA includes a plurality of pixel lines L1 to Ln. Each of the pixel lines L1 to Ln includes one line of pixels arranged along a line direction X in the pixel array AA of the display panel 100. Pixels arranged in one pixel line share the gate lines 103. Pixels arranged in a column direction Y along a data line direction share the same data line 102. One horizontal period 1H is a time obtained by dividing one frame period by the total number of pixel lines L1 to Ln.

The display panel 100 may be implemented as a non-transmissive display panel or a transmissive display panel. The transmissive display panel may be applied to a transparent display device in which an image is displayed on a screen and an actual background may be seen.

The display panel 100 may be implemented as a flexible display panel. The flexible display panel may be made of a plastic OLED panel. An organic thin film may be disposed on a back plate of the plastic OLED panel, and the pixel array AA and light emitting element may be formed on the organic thin film.

To implement color, each of the pixels 101 may be divided into a red sub-pixel (hereinafter referred to as "R sub-pixel"), a green sub-pixel (hereinafter referred to as "G sub-pixel"), and a blue sub-pixel (hereinafter referred to as "B sub-pixel"). Each of the pixels may further include a white sub-pixel. Each of the sub-pixels includes a pixel circuit. The pixel circuit is connected to the data line, the gate line and power line.

The pixels may be arranged as real color pixels and pentile pixels. The pentile pixel may realize a higher resolution than the real color pixel by driving two sub-pixels having different colors as one pixel 101 using a preset pixel rendering algorithm. The pixel rendering algorithm may compensate for insufficient color representation in each pixel with a color of light emitted from an adjacent pixel.

Touch sensors may be disposed on the display panel 100. A touch input may be sensed using separate touch sensors or may be sensed through pixels. The touch sensors may be disposed as an on-cell type or an add-on type on the screen of the display panel or implemented as in-cell type touch sensors embedded in the pixel array AA.

As shown in FIG. 15, when viewed from a cross-sectional structure, the display panel 100 may include a circuit layer 12, a light emitting element layer 14, and an encapsulation layer 16 stacked on a substrate 10.

The circuit layer 12 may include a pixel circuit connected to wirings such as a data line, a gate line, and a power line, a gate driver (GIP) connected to the gate lines, and the like. The wirings and circuit elements of the circuit layer 12 may include a plurality of insulating layers, two or more metal layers separated with the insulating layer therebetween, and an active layer including a semiconductor material.

The light emitting element layer 14 may include a light emitting element EL driven by a pixel circuit. The light emitting element EL may include a red (R) light emitting element, a green (G) light emitting element, and a blue (B) light emitting element. The light emitting element layer 14 may include a white light emitting element and a color filter. The light emitting elements EL of the light emitting element layer 14 may be covered by a protective layer including an organic film and a passivation film.

The light emitting element EL may be implemented as an OLED including an organic compound layer formed between an anode and a cathode. The organic compound layer may include, but is not limited to, a hole injection layer (HIL), a hole transport layer (HTL), a light emitting layer (EML), an electron transport layer (ETL), and an electron injection layer (EIL).

An organic light emitting diode used as the light emitting element may have a tandem structure in which a plurality of light emitting layers are stacked. The organic light emitting diode having the tandem structure may improve the luminance and lifespan of the pixel.

The encapsulation layer 16 covers the light emitting element layer 14 to seal the circuit layer 12 and the light emitting element layer 14. The encapsulation layer 16 may have a multilayered insulating structure in which an organic film and an inorganic film are alternately stacked. The inorganic film blocks the penetration of moisture and oxygen. The organic film planarizes the surface of the inorganic film. When the organic film and the inorganic film are stacked in multiple layers, a movement path of moisture or oxygen becomes longer compared to a single layer, so that penetration of moisture and oxygen affecting the light emitting element layer 14 can be effectively blocked.

A touch sensor layer may be disposed on the encapsulation layer 16. The touch sensor layer may include capacitive type touch sensors that sense a touch input based on a change in capacitance before and after the touch input. The touch sensor layer may include metal wiring patterns and insulating layers forming the capacitance of the touch sensors. The capacitance of the touch sensor may be formed between the metal wiring patterns. A polarizing plate may be disposed on the touch sensor layer. The polarizing plate may improve visibility and contrast ratio by converting the polarization of external light reflected by metal of the touch sensor layer and the circuit layer 12. The polarizing plate may be implemented as a polarizing plate in which a linear polarizing plate and a phase delay film are bonded, or a circular polarizing plate. A cover glass may be adhered to the polarizing plate.

The display panel 100 may further include a touch sensor layer and a color filter layer stacked on the encapsulation layer 16. The color filter layer may include red, green, and blue color filters and a black matrix pattern. The color filter layer may replace the polarizing plate and increase the color purity by absorbing a part of the wavelength of light reflected from the circuit layer and the touch sensor layer. In this embodiment, by applying the color filter layer 20 having a higher light transmittance than the polarizing plate to the display panel, the light transmittance of the display panel 100 can be improved, and the thickness and flexibility of the display panel 100 can be improved. A cover glass may be adhered on the color filter layer.

The power supply 140 generates DC power required for driving the pixel array AA and the display panel driver of the display panel 100 by using a DC-DC converter. The DC-DC converter may include a charge pump, a regulator, a buck converter, a boost converter, and the like. The power supply 140 may adjust a DC input voltage from a host system (not shown) and thereby generate DC voltages such as a gamma reference voltage VGMA, gate-on voltages VGH and VEH, gate-off voltages VGL and VEL, a pixel driving voltage ELVDD, a pixel low-potential power supply voltage ELVSS, a reference voltage Vref, an initial voltage Vinit, an anode voltage Vano, and the like. The gamma reference voltage VGMA is supplied to a data driver 110. The gate-on voltages VGH and VEH and the gate-off voltages VGL and VEL are supplied to a gate driver 120. The pixel driving voltage ELVDD and the pixel low-potential power supply voltage ELVSS, a reference voltage Vref, an initial voltage Vinit, an anode voltage Vano, and the like are commonly supplied to the pixels.

The display panel driver writes pixel data (digital data) of an input image to the pixels of the display panel 100 under the control of a timing controller (TCON) 130.

The display panel driver includes the data driver 110 and the gate driver 120. A display panel driver may further include a demultiplexer array 112 disposed between the data driver 110 and the data lines 102.

The demultiplexer array 112 sequentially supplies data voltages output from channels of the data driver 110 to the data lines 102 using a plurality of demultiplexers (DEMUXs). The demultiplexers may include a plurality of switch elements disposed on the display panel 100. When the demultiplexers are disposed between output terminals of the data driver 110 and the data lines 102, the number of channels of the data driver 110 may be reduced. The demultiplexer array 112 may be omitted.

The display panel driver may further include a touch sensor driver for driving the touch sensors. The touch sensor driver is omitted from FIG. 1. The touch sensor driver may be integrated into one drive integrated circuit (IC). In a mobile device or wearable device, the timing controller 130, the power supply 140, the data driver 110, the touch sensor driver, and the like may be integrated into one drive integrated circuit (IC).

A display panel driver may operate in a low-speed driving mode under the control of a timing controller (TCON) 130. The low-speed driving mode may be set to reduce power consumption of a display device when there is no change in an input image for a preset number of frames in analysis of the input image. In the low-speed driving mode, the power consumption of the display panel driver and a display panel 100 may be reduced by lowering a refresh rate of pixels when a still image is input for a predetermined time or longer. A low-speed driving mode is not limited to a case in which a still image is input. For example, when the display device operates in a standby mode or when a user command or an input image is not input to a display panel driver for a predetermined time or more, the display panel driver may operate in the low-speed driving mode.

The data driver 110 generates a data voltage Vdata by converting pixel data of an input image received from the timing controller 130 with a gamma compensation voltage every frame period by using a digital to analog converter (DAC). The gamma reference voltage VGMA is divided for respective gray scales through a voltage divider circuit. The gamma compensation voltage divided from the gamma reference voltage VGMA is provided to the DAC of the data driver 110. The data voltage Vdata is outputted through the output buffer AMP in each of the channels of the data driver 110.

The gate driver 120 may be implemented as a gate in panel (GIP) circuit formed directly on a circuit layer 12 of the display panel 100 together with the TFT array of the pixel array AA. The gate in panel (GIP) circuit may be disposed on a bezel area BZ that is a non-display area of the display panel 100 or dispersed in the pixel array on which an input image is reproduced. The gate driver 120 sequentially outputs gate signals to the gate lines 103 under the control of the timing controller 130. The gate driver 120 may sequentially supply the gate signals to the gate lines 103 by shifting the gate signals using a shift register. The gate signal may include scan pulses, emission control pulses (hereinafter referred to as "EM pulses"), initial pulses, and sensing pulses. Therefore, the gate driver 120 may include a scan driver 121, an emission control driver 122, an initialization driver 123, and the like.

The shift register of the gate driver 120 outputs a pulse of the gate signal in response to a start pulse and a shift clock from the timing controller 130, and shifts the pulse according to the shift clock timing.

In this case, the gate driver 120 may be implemented as a gate driver capable of decreasing a leakage current while reducing the number of transistors as shown in FIGS. 1, 3, 6, and 8. In the present invention, all transistors in the display panel including the data driver, the gate driver, and sub-pixels may be implemented with oxide thin film transistors (TFTs) including an n-channel type oxide semiconductor.

The timing controller 130 receives, from a host system (not shown), digital video data DATA of an input image and a timing signal synchronized therewith. The timing signal includes a vertical synchronization signal Vsync, a horizontal synchronization signal Hsync, a main clock CLK, a data enable signal DE, and the like. Because a vertical period and a horizontal period can be known by counting the data enable signal DE, the vertical synchronization signal Vsync and the horizontal synchronization signal Hsync may be omitted. The data enable signal DE has a cycle of one horizontal period (1H).

A host system may be any one of a television (TV) system, a tablet computer, notebook computer, a navigation system, a personal computer (PC), a home theater system, a mobile device, and a vehicle system. The host system may scale an image signal from a video source according to the resolution of the display panel 100 and transmit the image signal to a timing controller 130 together with the timing signal.

The timing controller 130 multiplies an input frame frequency by i and controls the operation timing of the display panel driver with a frame frequency of the input frame frequency×i (i is a positive integer greater than 0) Hz. The input frame frequency is 60 Hz in the NTSC (National Television Standards Committee) scheme and 50 Hz in the PAL (Phase-Alternating Line) scheme. The timing controller 130 may lower a driving frequency of the display panel driver by lowering a frame frequency to a frequency between 1 Hz and 30 Hz to lower a refresh rate of pixels in the low-speed driving mode.

Based on the timing signals Vsync, Hsync, and DE received from the host system, the timing controller 130 generates a data timing control signal for controlling the operation timing of the data driver 110, a control signal for controlling the operation timing of the de-multiplexer array 112, and a gate timing control signal for controlling the operation timing of the gate driver 120. The timing controller 130 controls an operation timing of the display panel driver to synchronize the data driver 110, the demultiplexer array 112, a touch sensor driver, and a gate driver 120.

The voltage level of the gate timing control signal outputted from the timing controller 130 may be converted into the gate-on voltages VGH and VEH and the gate-off voltages VGL and VEL through a level shifter (not shown) and then supplied to the gate driver 120. That is, the level shifter converts a low level voltage of the gate timing control signal into the gate-off voltages VGL and VEL and converts a high level voltage of the gate timing control signal into the gate-on voltages VGH and VEH. The gate timing control signal includes the start pulse and the shift clock.

Figure 16A:
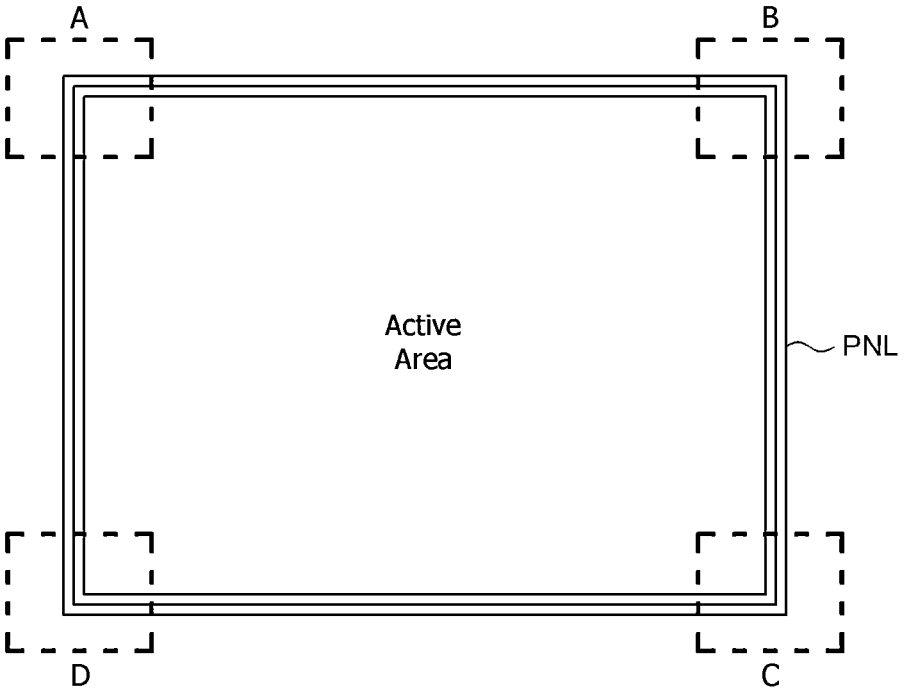
FIGS. 16A and 16B are views for describing a position of a gate driver according to the embodiment.
Figure 16B:
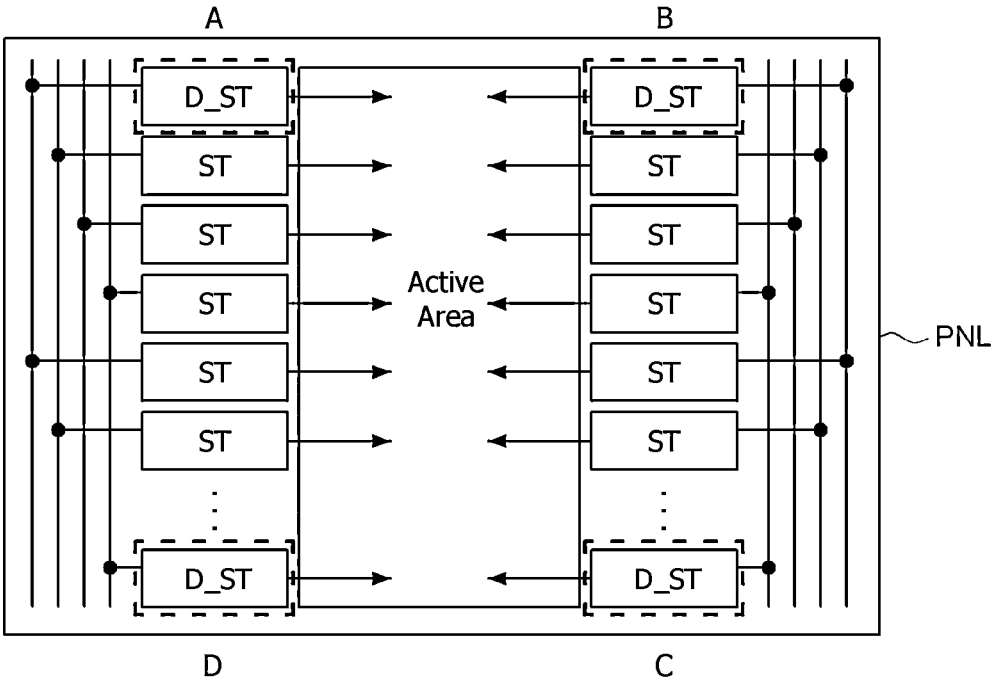
Figure 17:
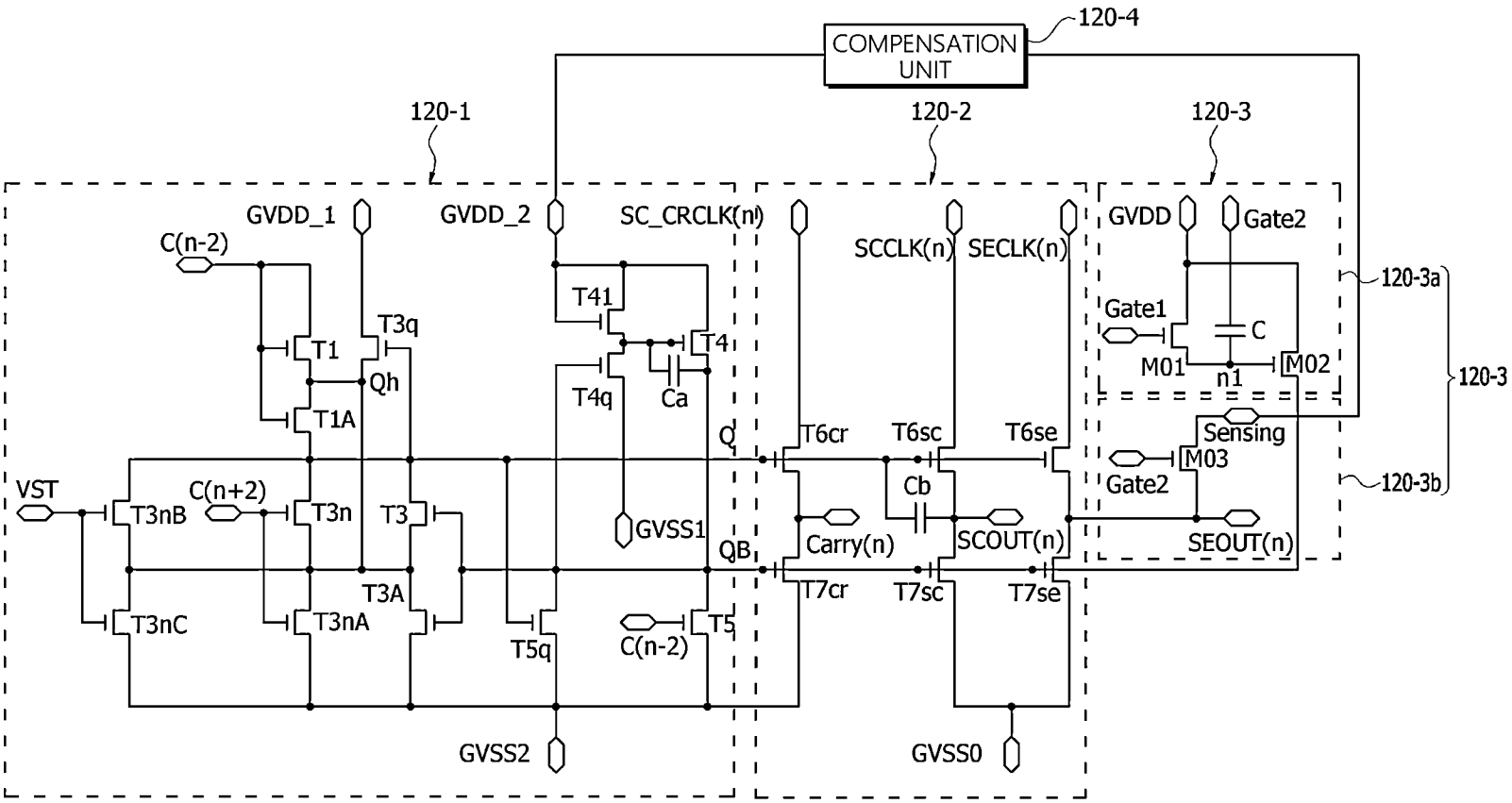
FIG. 17 is a view illustrating an actually implemented circuit of the gate driver according to the embodiment.
Figure 18:
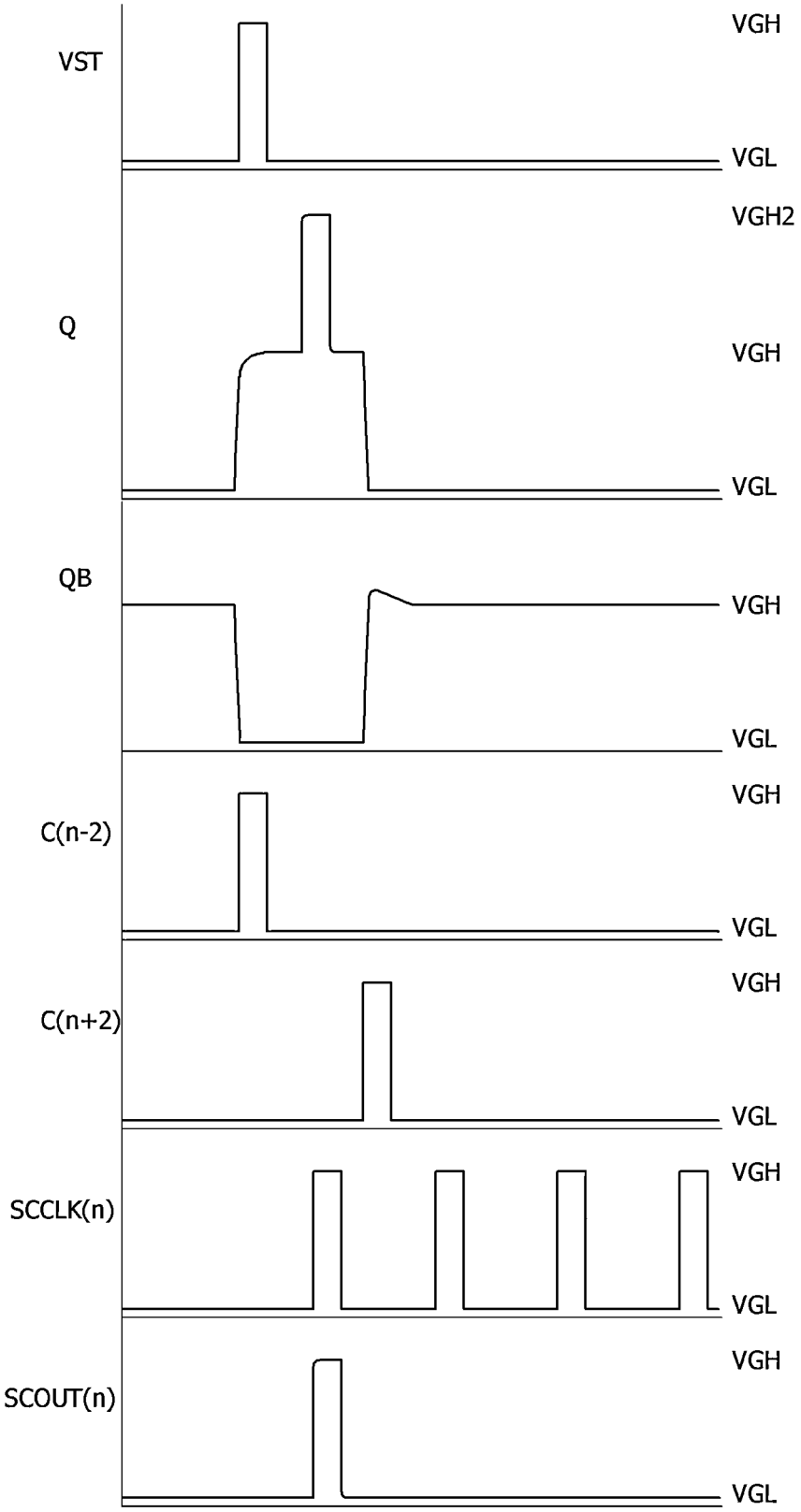
FIG. 18 is waveform diagrams illustrating voltages of input/output signals and nodes of the gate driver shown in FIG. 17.
Figure 19:
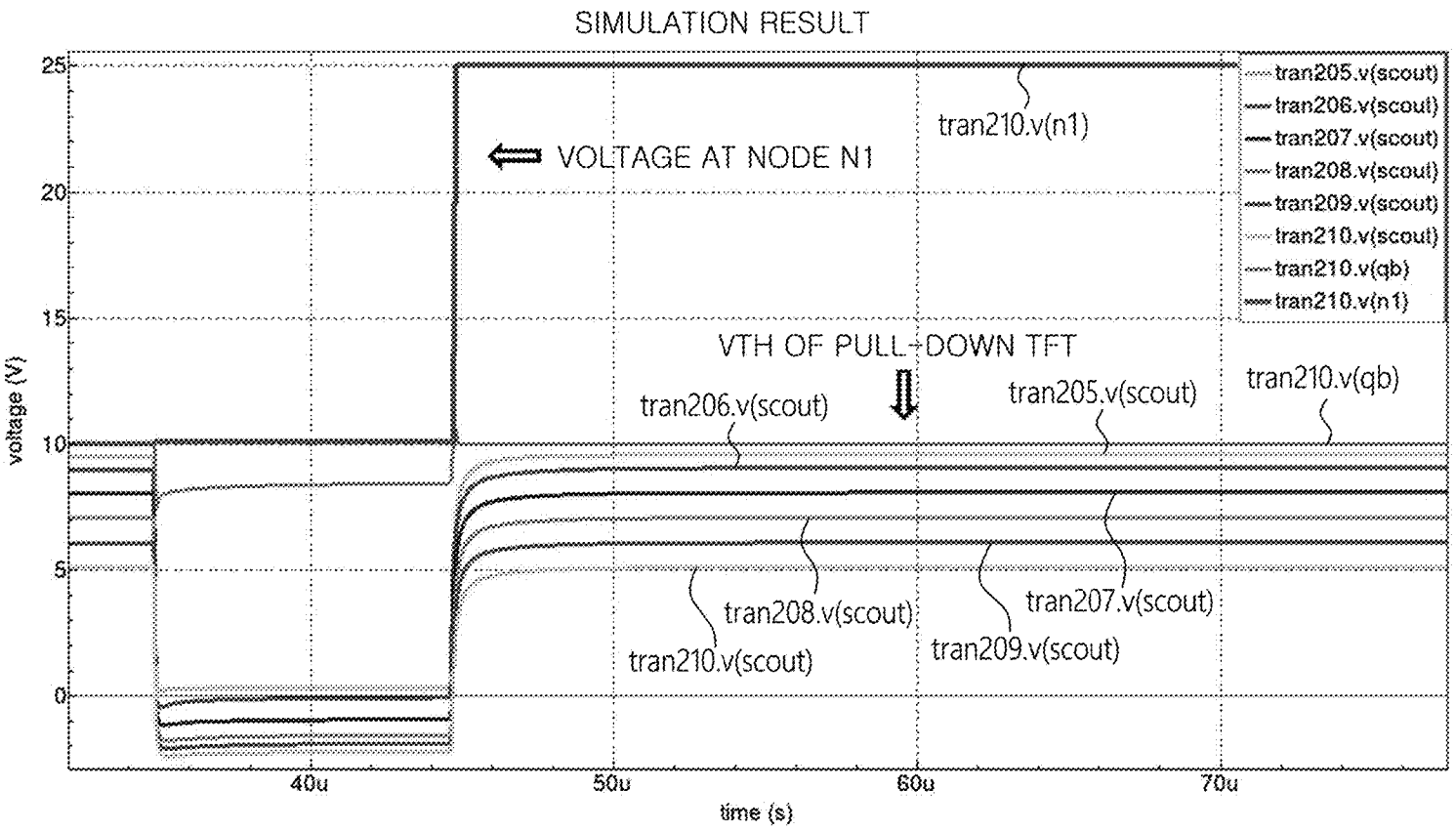
FIG. 19 is a view illustrating a sensing result (simulation result) of a threshold voltage of the pull-down transistor.

FIGS. 16A and 16B are views for describing a position of a gate driver according to the embodiment, FIG. 17 is a view illustrating an actually implemented circuit of the gate driver according to the embodiment, FIG. 18 is waveform diagrams illustrating voltages of input/output signals and nodes of the gate driver shown in FIG. 17, and FIG. 19 is a view illustrating a sensing result (simulation result) of a threshold voltage of the pull-down transistor. Here, an example in which the gate driver is implemented as a scan driver will be described Referring to FIGS. 16A and 16B, the scan driver according to the embodiment may be implemented in a structure in which shift registers are disposed in left and right non-display regions of a display panel. The shift registers may each include a plurality of signal transmission units ST and a plurality of dummy signal transmission units D_ST.

In this case, the plurality of signal transmission units ST are respectively connected to gate lines. Each of the plurality of dummy signal transmission units D_ST may be disposed at uppermost end portions A and B and lowermost end portions C and D at both sides of a display panel PNL. Here, a case in which four dummy signal transmission units D_ST are formed is shown.

Each of the plurality of dummy signal transmission units disposed at the uppermost end and the lowermost end of the display panel may be implemented to include the sensing unit and the compensation unit shown in FIG. 1. The reason why the sensing unit and the compensation unit are included in only the dummy signal transmission unit (i.e., at only the uppermost end portions and the lowermost end portions) is to minimize an increase in a bezel (outside the active area) of the display panel.

Referring to FIG. 17, and FIG. 18, a dummy signal transmission unit according to the embodiment of the present disclosure may be implemented to include a controller 120-1, an output unit 120-2, a sensing unit 120-3 composed of a first sensing unit 120-3*a* and a second sensing unit 120-3*b*, and a compensation unit 120-4.

The controller 120-1 may serve to charge and discharge a first control node and a second control node. The controller 120-1 may include a first transistor T1, a first-A transistor T1A, a third transistor T3, a third-A transistor T3A, a third-q transistor T3*q*, a third-n transistor T3*n*, a third-nA transistor T3*n*A, a third-nB transistor T3*n*B, a third-nC transistor T3*n*C, a fourth transistor T4, a fourth-1 transistor T41, a fourth-q transistor T4*q*, a fifth transistor T5, and a fifth-q transistor T5*q*.

The first transistor T1 is turned on by an N−2th carry signal applied through an N−2th carry signal line C(n−2), and charges a Q node Q based on the N−2th carry signal. The first transistor T1 includes a gate electrode and a first electrode commonly connected to the N−2th carry signal line C(n−2), and a second electrode connected to the Q node Q.

The first-A transistor T1A is turned on by the N−2th carry signal applied through the N−2th carry signal line C(n−2), and charges the Q node Q based on the N−2th carry signal. In the first-A transistor T1A, a gate electrode is connected to the N−2th carry signal line C(n−2), a first electrode is connected to the second electrode of the first transistor T1, and a second electrode is connected to the Q node Q.

The third transistor T3 is turned on by the QB node QB, and discharges the Q node Q to a third low potential voltage of a third low potential voltage GVSS2 line together with the third-A transistor T3A. In the third transistor T3, a gate electrode is connected to the QB node QB, a first electrode is connected to the Q node Q, and a second electrode is connected to a first electrode of the third-A transistor T3A.

The third-A transistor T3A is turned on by the QB node QB, and discharges the Q node Q to the third low potential voltage of the third low potential voltage GVSS2 line together with the third transistor T3. In the third-A transistor T3A, a gate electrode is connected to the QB node QB, the first electrode is connected to the second electrode of the third transistor T3, and a second electrode is connected to the third low potential voltage GVSS2 line.

The third-n transistor T3*n* is turned on by an N+2th carry signal applied through an N+2th carry signal line C(n+2), and discharges the Q node Q to the third low potential voltage of the third low potential voltage GVSS2 line together with the third-nA transistor T3*n*A. In the third-n transistor T3*n*, a gate electrode is connected to the N+2th carry signal line C(n+2), a first electrode is connected to the Q node Q, and a second electrode is connected to a first electrode of the third-nA transistor T3*n*A.

The third-nA transistor T3*n*A is turned on by the N+2th carry signal applied through the N+2th carry signal line C(n+2), and discharges the Q node Q to the third low potential voltage of the third low potential voltage GVSS2 line together with the third-n transistor T3*n*. In the third-nA transistor T3*n*A, a gate electrode is connected to the N+2th carry signal line C(n+2), the first electrode is connected to the second electrode of the third-n transistor T3*n*, and a second electrode is connected to the third low potential voltage GVSS2 line.

The third-q transistor T3*q* is turned on by the Q node Q, and transmits a high potential voltage of a first high potential voltage GVDD_1 line to a Qh node Qh. In the third-q transistor T3*q*, a gate electrode is connected to the Q node Q, a first electrode is connected to the first high potential voltage GVDD_1 line, and a second electrode is connected to the Qh node Qh.

The third-nB transistor T3*n*B is turned on by a start pulse received through a VST terminal, and discharges the Q node Q and the Qh node Qh to the third low potential voltage of the third low potential voltage GVSS2 line together with the third-nC transistor T3*n*C. In the third-nB transistor T3*n*B, a gate electrode is connected to the VST terminal, a first electrode is connected to the Q node Q, and a second electrode is connected to a first electrode of the third-nC transistor T3*n*C.

The third-nC transistor T3*n*C is turned on by the start pulse received through the VST terminal, and discharges the Q node Q and the Qh node Qh to the third low potential voltage of the third low potential voltage GVSS2 line together with the third-nB transistor T3*n*B. In the third-nC transistor T3*n*C, a gate electrode is connected to the VST terminal, the first electrode is connected to the second electrode of the third-nB transistor T3*n*B, and a second electrode is connected to the third low potential voltage GVSS2 line.

The fourth transistor T4 is turned on by a second high potential voltage transmitted through the fourth-1 transistor T41 and charges the QB node QB to the second high potential voltage applied to a second high potential voltage GVDD_2 line. A first capacitor Ca serves to form a bootstrapping voltage at a gate node of the fourth transistor T4. In the fourth transistor T4, a gate electrode is connected to one end of the first capacitor Ca and a second electrode of the fourth-1 transistor T41, a first electrode is connected to the second high potential voltage GVDD_2 line, and a second electrode is connected to the other end of the first capacitor Ca and the QB node QB.

The fourth-1 transistor T41 is turned on by the second high potential voltage and transmits the second high potential voltage applied to the second high potential voltage GVDD_2 line to the gate node of the fourth transistor T4. In the fourth-1 transistor T41, a gate electrode and a first electrode are connected to the second high potential voltage line GVDD_2, and the second electrode is connected to the gate electrode of the fourth transistor T4 and a first electrode of the fourth-q transistor T4*q*.

The fourth-q transistor T4*q* is turned on to connect the gate node of the fourth transistor T4 to the low potential voltage GVSS1 line to discharge the gate node of the fourth transistor T4 to a low potential voltage when a voltage of the QB node is a high voltage greater than or equal to a gate-on voltage VGH. In the fourth-q transistor T4*q*, a gate electrode is connected to the QB node, the first electrode is connected to the gate electrode of the fourth transistor T4 and a second electrode of the fourth-1 transistor T41, and a second electrode is connected to the low potential voltage GVSS1 line.

The fifth transistor T5 is turned on by the N−2th carry signal applied through the N−2th carry signal line C(n−2) and connects the QB node to the low potential voltage GVSS2 line to discharge the QB node to the low potential voltage. The fifth transistor T5 includes a gate electrode connected to the N−2th carry signal line C(n−2), a first electrode connected to the QB node, and a second electrode connected to the low potential voltage line.

The fifth-q transistor T5*q* is turned on to connect the QB node to the low potential voltage GVSS2 line to discharge the QB node to the low potential voltage when the voltage of the Q node Q is a high voltage greater than or equal to the gate-on voltage VGH. The fifth-q transistor T5*q* includes a gate electrode connected to the Q node Q, a first electrode connected to the QB node, and a second electrode connected to the low potential voltage GVSS2 line.

The output unit 120-2 may output a gate signal in response to charging voltages of the first control node and the second control node. The output unit 120-2 includes first buffer transistors T6*cr* and T7*cr* which output a carry signal, second buffer transistors T6*sc* and T7*sc* which output a scan signal, and third buffer transistors T6*se* and T7*se*.

The first buffer transistors T6*cr* and T7*cr* may be divided into a first pull-up transistor T6*cr* that is turned on based on a potential of the Q node Q and a first pull-down transistor T7*cr* that is turned on based on a potential of the QB node QB. In the first pull-up transistor T6*cr*, a gate electrode is connected to the Q node Q, a first electrode is connected to a clock signal line SC_CRCLK(n), and a second electrode is connected to an output terminal Carry(n). In the first pull-down transistor T7*cr*, a gate electrode is connected to the QB node QB, a first electrode is connected to the output terminal Carry(n), and a second electrode is connected to the low potential voltage GVSS2 line.

The second buffer transistors T6*sc* and T7*sc* may be divided into a second pull-up transistor T6*sc* that is turned on based on the potential of the Q node Q and a second pull-down transistor T7*sc* that is turned on based on the potential of the QB node QB. In the second pull-up transistor T6*sc*, a gate electrode is connected to the Q node Q and one end of a second capacitor Cb, a first electrode is connected to a clock signal line SCCLK(n) to which a clock signal is applied, and a second electrode is connected to the other end of the second capacitor Cb and an output terminal SCOUT (n). In the second pull-down transistor T7*sc*, a gate electrode is connected to the QB node QB, a first electrode is connected to the output terminal SCOUT(n), and a second electrode is connected to a low potential voltage GVSS0 line.

The third buffer transistors T6*se* and T7*se* may be divided into a third pull-up transistor T6*se* that is turned on based on the potential of the Q node Q and a third pull-down transistor T7*se* that is turned on based on the potential of the QB node QB. In the third pull-up transistor T6*se*, a gate electrode is connected to the Q node Q, a first electrode is connected to a clock signal line SECLK(n), and a second electrode is connected to an output terminal SEOUT(n). In the third pull-down transistor T7*se*, a gate electrode is connected to the QB node QB, a first electrode is connected to the output terminal SEOUT(n), and a second electrode is connected to the low potential voltage GVSS0 line.

The sensing unit 120-3 may sense a threshold voltage of the pull-down transistor. The sensing unit 120-3 includes a first sensing unit 120-3*a* composed of a first switch element M01, a second switch element M02, and a capacitor C, and a second sensing unit 120-3*b* composed of a third switch element M03.

The first switch element M01 may be turned on to apply a high potential voltage to a first node n1 when a first gate signal is at a high voltage greater than or equal to a gate-on voltage. The first switch element M01 includes a gate electrode to which the first gate signal Gate1 is applied, a first electrode connected to a high potential voltage line to which the high potential voltage GVDD is applied, and a second electrode connected to the first node n1.

The second switch element M02 may be turned on to apply the high potential voltage to the second control node when the voltage of the first node n1 is a high voltage greater than or equal to the gate-on voltage. The second switch element M02 includes a gate electrode connected to the first node n1, a first electrode connected to the high potential voltage line to which the high potential voltage GVDD is applied, and a second electrode connected to the second control node.

The third switch element M03 may be turned on to sense the threshold voltage of the pull-down transistor and transmit the threshold voltage to a sensing line when a second gate signal is at a high voltage greater than or equal to the gate-on voltage. The third switch element M03 includes a gate electrode to which the second gate signal Gate2 is applied, a first electrode connected to the sensing line Sensing, and a second electrode connected to an output node SEOUT(n).

The capacitor C is connected between the signal line to which the second gate signal Gate2 is applied and the first node n1. The capacitor C may serve to form a bootstrapping voltage at the first node.

The compensation unit 120-4 may change the charging voltage of the second control node in response to an output of the sensing unit. The compensation unit 120-4 may change the second high potential voltage applied to the second high potential voltage GVDD_2 line connected to the second control node in response to the output of the sensing unit.

The compensation unit 120-4 may change the second high potential voltage applied to the second high potential voltage GVDD_2 line in proportion to the threshold voltage of the pull-down transistor T7*cr*, T7*sc*, and T7*se* sensed by the sensing unit.

Referring to FIG. 19, it can be seen that the threshold voltage of the pull-down transistor is normally sensed through the sensing unit during a sensing section in the dummy signal transmission unit according to the embodiment. It can be seen that sensing is normally performed even when the threshold voltage of the pull-down transistor is changed.

It will be apparent to those skilled in the art that various modifications and variations can be made in the gate driving circuit and the display panel including the same of the present disclosure without departing from the technical idea or scope of the disclosure. Thus, it is intended that the present disclosure cover the modifications and variations of this disclosure provided they come within the scope of the appended claims and their equivalents.

What is claimed is:

1. A gate driving circuit, comprising:

a controller configured to charge and discharge a first control node that pulls up an output voltage and a second control node that pulls down the output voltage;

an output unit including a pull-up transistor configured to apply a gate high voltage to an output node in response to a charging voltage of the first control node, and a pull-down transistor configured to apply a gate low voltage to the output node in response to a charging voltage of the second control node;

a sensing unit configured to sense a threshold voltage of the pull-down transistor; and a compensation unit configured to change the charging voltage of the second control node in response to an output of the sensing unit.

2. The gate driving circuit of claim 1, wherein the sensing unit includes:

a first sensing unit configured to apply an initialization voltage to the second control node; and a second sensing unit configured to sense the threshold voltage of the pull-down transistor.

3. The gate driving circuit of claim 2, wherein the first sensing unit includes a first switch element having a gate electrode to which a first gate signal is applied, a first electrode connected to a high potential voltage line to which a high potential voltage is applied, and a second electrode connected to the second control node.

4. The gate driving circuit of claim 3, wherein the second sensing unit includes a second switch element having a gate electrode to which the first gate signal is applied, a first electrode connected to a sensing node, and a second electrode connected to the output node.

5. The gate driving circuit of claim 2, wherein the first sensing unit includes:

a first switch element having a gate electrode to which a first gate signal is applied, a first electrode connected to a high potential voltage line to which a high potential voltage is applied, and a second electrode connected to the second control node; and a capacitor connected between the gate electrode and the second electrode of the first switch element.

6. The gate driving circuit of claim 5, wherein the second sensing unit includes a second switch element having a gate electrode to which the first gate signal is applied, a first electrode connected to a sensing node, and a second electrode connected to the output node.

7. The gate driving circuit of claim 2, wherein the first sensing unit includes:

a first switch element having a gate electrode to which a first gate signal is applied, a first electrode connected to a high potential voltage line to which a high potential voltage is applied, and a second electrode connected to a first node;

a second switch element having a gate electrode connected to the first node, a first electrode connected to the high potential voltage line, and a second electrode connected to the second control node; and a capacitor connected between the first node and a signal line to which a second gate signal is applied.

8. The gate driving circuit of claim 7, wherein the second sensing unit includes a third switch element having a gate electrode to which the second gate signal is applied, a first electrode connected to a sensing node, and a second electrode connected to the output node.

9. The gate driving circuit of claim 8, wherein:

a section in which the threshold voltage is sensed includes a first section in which a high voltage of the first gate signal is maintained and a second section in which a high voltage of the second gate signal is maintained;

the first switch element and the second switch element are turned on in the first section; and the second switch element and the third switch element are turned on in the second section.

10. The gate driving circuit of claim 1, comprising:

a first high potential voltage line configured to apply a first high potential voltage to the first control node; and a second high potential voltage line configured to apply a second high potential voltage to the second control node.

11. The gate driving circuit of claim 10, wherein the compensation unit changes the second high potential voltage according to the threshold voltage sensed from the sensing unit.

12. The gate driving circuit of claim 11, wherein the compensation unit changes the second high potential voltage in proportion to the sensed threshold voltage.

13. The gate driving circuit of claim 1, wherein:

the second control node is a gate node of the pull-down transistor; and the gate driving circuit further includes:

a first clock signal line configured to apply a first clock signal to the first control node; and a second clock signal line configured to apply a second clock signal to the second control node.

14. The gate driving circuit of claim 13, wherein the compensation unit changes a magnitude of the second clock signal according to the threshold voltage sensed from the sensing unit.

15. The gate driving circuit of claim 13, wherein the compensation unit changes a magnitude of the second clock signal in proportion to the sensed threshold voltage.

16. The gate driving circuit of claim 1, wherein the compensation unit includes:

an analog-to-digital converter which converts the sensed threshold voltage to digital data; and a compensation voltage generation circuit which changes a magnitude of a high potential voltage supplied through a high potential voltage line connected with the compensation unit based on the converted digital data and a look-up table and apply the high potential voltage to the second control node.

17. The gate driving circuit of claim 1, wherein the pull-up transistor includes first, second and third pull-up transistors which are turned on based on a potential of the first control node, wherein the pull-down transistor includes first, second and third pull-down transistors which are turned on based on a potential of the second control node, and wherein the output unit further includes a capacitor, and the second pull-up transistor includes a gate electrode which is connected to the first control node and one end of the capacitor, a first electrode which is connected to a clock signal line to which a clock signal is applied, and a second electrode which is connected to the other end of the capacitor and the output node.

18. The gate driving circuit of claim 1, wherein the controller includes:

a first transistor which includes a gate electrode and a first electrode commonly connected to a start pulse terminal, and a second electrode connected to the first control node;

a third transistor which includes a gate electrode connected to a carry signal terminal, a first electrode connected to the first control node, and a second electrode connected to a low potential voltage line to which a low potential voltage is applied;

a fourth transistor which includes a gate electrode connected to a reset signal terminal, a first electrode connected to the first control node, and a second electrode connected to the low potential voltage line; and a fifth transistor which includes a gate electrode to which a clock signal is applied, a first electrode connected to the first control node, and a second electrode connected to an output terminal.

19. The display panel of claim 18, wherein all transistors in the display panel including the data driver, the gate driver, and sub-pixels are implemented with oxide thin film transistors (TFTs) including an n-channel type oxide semiconductor.

20. A display panel, comprising:

a data driver configured to output a data voltage;

a gate driver configured to output a gate signal according to voltages of a first control node that pulls up an output voltage and a second control node that pulls down the output voltage; and a plurality of pixel circuits configured to receive the data voltage and the gate signal to reproduce an input image, wherein the gate driver includes:

a controller configured to charge and discharge the first control node and the second control node;

an output unit including a pull-up transistor configured to apply a gate signal of a gate high voltage to an output node in response to a charging voltage of the first control node, and a pull-down transistor configured to apply a gate signal of a gate low voltage to the output node in response to a charging voltage of the second control node;

a sensing unit configured to sense a threshold voltage of the pull-down transistor; and a compensation unit configured to change the charging voltage of the second control node in response to an output of the sensing unit.

* * * * *